US006775489B2

(12) United States Patent
Tsuruya et al.

(10) Patent No.: US 6,775,489 B2
(45) Date of Patent: Aug. 10, 2004

(54) IMAGE FORMING APPARATUS CAPABLE OF DETECTING DENSITY OF TONER IMAGE

(75) Inventors: Takaaki Tsuruya, Shizuoka (JP); Kazuhiro Funatani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/161,709

(22) Filed: Jun. 5, 2002

(65) Prior Publication Data

US 2002/0186980 A1 Dec. 12, 2002

(30) Foreign Application Priority Data

Jun. 7, 2001 (JP) ..... 2001/172576
Aug. 6, 2001 (JP) ..... 2001/237458

(51) Int. Cl.[7] ..... G03G 15/00
(52) U.S. Cl. ..... 399/49
(58) Field of Search ..... 399/49

(56) References Cited

U.S. PATENT DOCUMENTS 5,103,260 A 4/1992 Tompkins et al. ..... 355/208
5,991,558 A * 11/1999 Emi et al. ..... 399/49
6,456,803 B2 * 9/2002 Suzuki et al. ..... 399/49
6,463,227 B1 * 10/2002 Denton et al. ..... 399/49
6,477,338 B2 * 11/2002 Hisano et al. ..... 399/49
6,512,898 B2 * 1/2003 Funatani ..... 399/49
6,516,163 B2 * 2/2003 Nakai et al. ..... 399/49
6,560,418 B2 * 5/2003 Campbell et al. ..... 399/49
6,564,021 B1 * 5/2003 Nakai et al. ..... 399/49

FOREIGN PATENT DOCUMENTS

JP 5-249787 9/1993
JP 6-250480 9/1994

* cited by examiner

*Primary Examiner*—Fred Braun
(74) *Attorney, Agent, or Firm*—Fitzpatrick, Cella, Harper & Scinto

(57) ABSTRACT

An image forming apparatus includes an image forming device for forming an image which is capable of forming a toner image for density detection, and a detector for irradiating light to the toner image for density detection and detecting light obtained from the toner image for density detection, in which: the image forming device is controlled based on an output from the detector; the toner image for density detection includes a first toner image and a second toner image having a light reflectance lower than that of the first toner image; and the detector detects the first toner image formed on the second toner image in the case where a density of the first toner image is detected.

22 Claims, 19 Drawing Sheets

IMAGE FORMING APPARATUS CAPABLE OF DETECTING DENSITY OF TONER IMAGE

BACKGROUND OF THE INVENTION

1. Field of the Invention

The present invention relates to an image forming apparatus such as a copying machine or a printer, and particularly to an apparatus for performing density control of images.

2. Related Background Art

Recently, image forming apparatus of an electrophotographic apparatus have come to be color type ones, and color image forming apparatus have adopted various methods such as an image on image development method, an intermediate transfer method and an electrostatic transfer member method.

In the image on image development method, toner images of a plurality of colors are superimposed and developed temporarily on a photosensitive drum and collectively transferred onto a transfer material to form a final image.

In the intermediate transfer method, toner images of a plurality of colors are superimposed and transferred temporarily onto an intermediate transfer member (primary transfer) and then collectively transferred onto a transfer material (secondary transfer) to form a final image.

In the electrostatic transfer member method, an electrostatic transfer member is made to attract a transfer material, and toner images are superimposed on the transfer material to form an image.

The above-described methods all have both advantages and disadvantages, that is, good points and bad points. Whichever method is adopted, there exists a defect that an original correct color cannot be obtained due to a little fluctuation of image density based on various conditions such as a change of the usage environment and the number of prints.

In the color image forming apparatus of the electrophotographic method, image density control is generally performed in which toner images for density detection (patches) are formed from respective color toners on trial, the toner amount is detected by a density sensor, and the result is fed back to image forming conditions. In general, in the image density control, maximum density control with the purpose of constantly maintaining the maximum density of each color is performed first, and then, halftone control with the purpose of constantly maintaining gradation characteristics of halftone to an image signal is performed.

FIG. 7 shows a density sensor 112 for measuring a toner adhering amount of a patch T, in which reference symbol 112*a* indicates a light emitting element such as an LED and reference symbol 112*b* indicates a light receiving element such as a photodiode. The patch T is generally formed on a base, that is, the photosensitive member in the image on image development method, the intermediate transfer member (for example, drum or belt) in the intermediate transfer method, or the electrostatic transfer member (for example, belt) in the electrostatic transfer member method.

When a measurement light L1 is irradiated from the light emitting element 112*a*, a light L2 reflected from a surface of the base of the patch T enters the light receiving element 112*b*, and a light receiving signal is output. In the case where the toner adhering amount of the patch T is large, the reflection light L2 is blocked much by the toner, and thus, a light receiving amount of the light receiving element 112*b* decreases. Conversely, in the case where the toner adhering amount of the patch T is small, the reflection light L2 is less blocked, and thus, the light receiving amount of the light receiving element 112*b* increases. In other words, in the case where the patch T completely covers the base, the light receiving signal is minimum while in the case where the patch T does not exist, the light receiving signal is maximum.

FIG. 8 shows a result of measurement of a black (K) toner with the above-mentioned density sensor. The horizontal axis indicates a toner adhering amount, and the vertical axis indicates a light receiving amount. The light receiving amount decreases as the toner adhering amount increases, and the toner adhering amount can be correctly measured.

FIG. 9 shows a result of measurement of a toner of color different from black with the above-mentioned density sensor. The horizontal axis indicates a toner adhering amount, and the vertical axis indicates a light receiving amount. At first, the light receiving amount decreases along with the increase in the toner adhering amount, but when the toner adhering amount reaches a constant amount (indicated by Q in the figure), the light receiving amount conversely increases. Thus, the toner adhering amount cannot be measured with accuracy.

This phenomenon is explained with reference to FIG. 10. The light L2 that enters the light receiving element 112*b* increases or decreases in accordance with the adhering amount of the toner on the base surface. However, in case of a color toner, a reflection light L3 that is a diffuse reflection light component caused by the toner portion exists, and the reflection light L3 also enters the light receiving element 112*b*. In case of a black toner, since the toner portion hardly attracts and reflects light, the reflection light L3 hardly exists even if the toner adhering amount increases. Thus, the result shown in FIG. 8 is provided. In case of the color toner, when the toner adhering amount increases, the reflection light L2 from the base surface decreases, but the reflection light L3 caused by the toner portion increases. Thus, the result shown in FIG. 9 is provided.

Further, as shown in FIG. 11, in the case where the light receiving element 112*b* is arranged in a normal direction to the patch T surface, if the base surface is near a mirror surface of the light receiving element 112*b*, the reflection light L2 from the base portion does not enter the light receiving element 112*b*, and the light receiving element 112*b* can receive and detect the diffuse reflection light L3 from the color toner portion. However, if the reflection light component from the base cannot be received, it becomes impossible to detect the black toner. In order to prevent this, it is sufficient that processing is performed such that the base surface is not made into a mirror surface to enable diffuse reflection. However, this again causes a problem in that the reflection component from the color toner portion and the reflection component from the base portion cannot be separated from each other at the time of detection of the color toner.

That is, in a conventional method, the reflection light L2 from the base and the reflection light L3 from the color toner portion cannot be reliably separated. Thus, detection accuracy is poor.

SUMMARY OF THE INVENTION

The present invention has been made in view of the above, and has an object thereof to provide an image forming apparatus in which a density for both a black toner and a color toner can be detected with accuracy while a structure thereof is not made complicated.

Another object of the present invention is to provide an image forming apparatus including:

image forming means for forming an image which is capable of forming a toner image for density detection; and detecting means for irradiating light to the toner image for density detection and detecting light obtained from the toner image for density detection, in which:

the image forming means is controlled based on an output from the detecting means;

the toner image for density detection includes a first toner image and a second toner image having a light reflectance lower than that of the first toner image; and the detecting means detects the first toner image formed on the second toner image in the case where a density of the first toner image is detected.

Still another object of the present invention is to provide an image forming apparatus including:

image forming means for forming an image which is capable of forming a toner image for density detection; and detecting means for irradiating light to the toner image for density detection and detecting light obtained from the toner image for density detection, in which:

the image forming means is controlled based on an output from the detecting means;

the toner image for density detection includes a first toner image and a second toner image, the first toner image is a toner image of a color different from black, and the second toner image is a black toner image; and the detecting means detects the first toner image formed on the second toner image in the case where a density of the first toner image is detected.

Other objects of the present invention will be apparent from the following description.

DESCRIPTION OF THE PREFERRED EMBODIMENTS

Hereinafter, embodiments of the present invention will be described with reference to the accompanying drawings.

Figure 1:
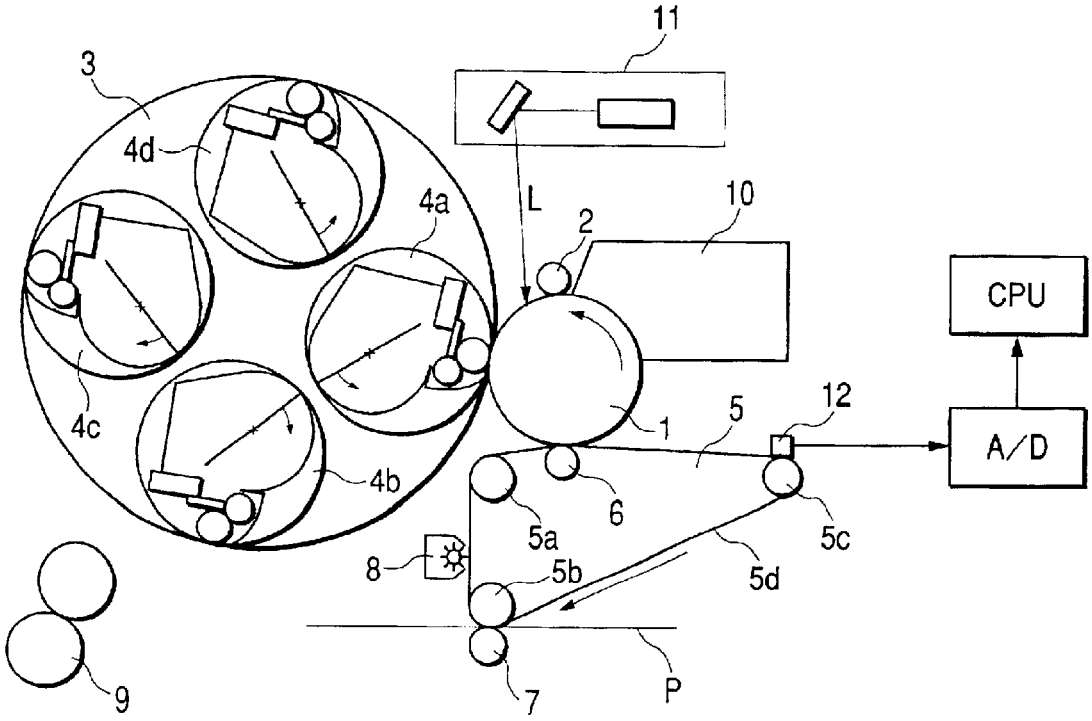
FIG. 1 is a sectional diagram of a color image forming apparatus in accordance with an embodiment of the present invention.

FIG. 1 is a sectional diagram of a color image forming apparatus in accordance with an embodiment.

In the apparatus main body, there are provided a photosensitive drum 1 that is an image bearing member, a contact type roller charger 2, a support member 3 that rotatably holds a plurality of developing devices 4*a*, 4*b*, 4*c* and 4*d* on the left side of the photosensitive drum 1, and a transfer device 5 under the photosensitive drum 1. Further, the developing devices 4*a*, 4*b*, 4*c* and 4*d* contain toners of magenta (hereinafter abbreviated to M), cyan (hereinafter abbreviated to C), yellow (hereinafter abbreviated to Y) and black (hereinafter abbreviated to K), respectively. In addition, the developing devices 4*a*, 4*b*, 4*c* and 4*d*, which are attached to the support member 3, are each driven such that an opening surface thereof is always opposed to the surface of the photosensitive drum. An exposure device 11 is arranged above the photosensitive drum 1.

The photosensitive drum 1 is driven by a driving means (not shown) in a direction indicated by an arrow in the figure. Further, the photosensitive drum 1 is structured such that an outer circumferential surface of an aluminum cylinder is applied with a photoconductor such as an organic photoconductor (OPC), A-Si, CdS or Se.

The transfer device 5 has three support rollers 5*a*, 5*b* and 5*c* as support members for a transfer member. One of the support rollers is a drive roller, the rest of the two rollers are driven rollers. An intermediate transfer belt 5*d* that is a toner image bearing member is wound around the support rollers, and is driven by a driving means (not shown) in a direction indicated by an arrow in the figure. A primary transfer roller 6 is arranged through the intermediate transfer belt 5*d* so as to be substantially opposed to the photosensitive drum 1. A secondary transfer roller 7 for transferring a toner image to a transfer material P is arranged so as to be opposed to the support roller 5*b*. Further, an intermediate transfer belt cleaning device 8 is provided between a secondary transfer and a primary transfer.

Reference numeral 12 indicates a density sensor that is a detecting means for image density control, which is provided to face the surface of the intermediate transfer belt 5*d*.

The contact type roller charger 2 uniformly charges the photosensitive drum 1. When a signal in accordance with an image pattern of M is input to a laser driver, laser light passes through a light path L and is irradiated to the photosensitive drum 1 by the exposure device 11, thereby forming an electrostatic latent image on the photosensitive drum 1. Further, when the photosensitive drum 1 advances in the arrow direction, the electrostatic latent image is visualized by the developing device 4*a*.

The toner image on the photosensitive drum 1 is transferred (primary transfer) by a voltage applied to the intermediate transfer belt 5*d* from a power source (not shown). The toner images of the respective colors on the intermediate transfer belt 5*d* which are formed by conducting the above-described process with respect to the colors of C, Y, K are transferred (secondary transfer) onto the transfer material P by the voltage applied to the intermediate transfer belt 5*d* from the power source (not shown). Then, the toner images are fusion-bonded by a heat and pressure-fixing device 9 to be obtained as color images. A transfer residual toner on the photosensitive drum 1 after the completion of developing is cleaned by a photosensitive drum cleaning device 10. The transfer residual toner on the intermediate transfer belt after the completion of the secondary transfer is removed by an intermediate transfer belt cleaning device 8.

Then, a description is made of image density control of a toner image of a color different from black in this embodiment.

Figure 2:
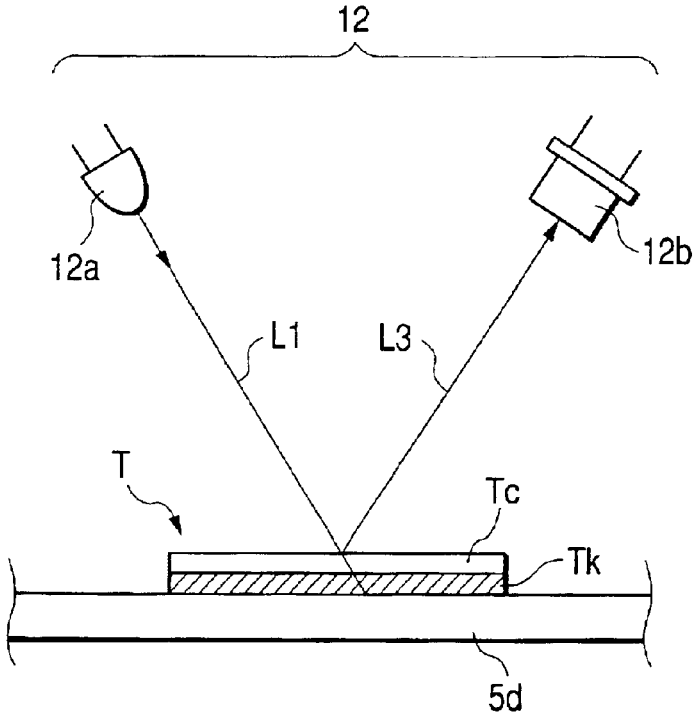
FIG. 2 is a schematic diagram in measurement of a toner adhering amount by means of a density sensor in accordance with the embodiment of the present invention.

FIG. 2 is a schematic diagram of measurement of a toner adhering amount of a patch in this embodiment. In the case where the image density control is conducted at the on-time of a power source, or the like, first, a base toner layer Tk that is a second toner image comprised of a K toner is formed on the intermediate transfer belt 5*d*. Then, a color toner patch Tc, that is, a first toner image, which is a control object, is formed on the base toner layer Tk of K, and the density sensor 12 measures the density of the color toner patch Tc. Note that the second toner image has a lower light reflectance than that of the first toner image.

Figure 3:
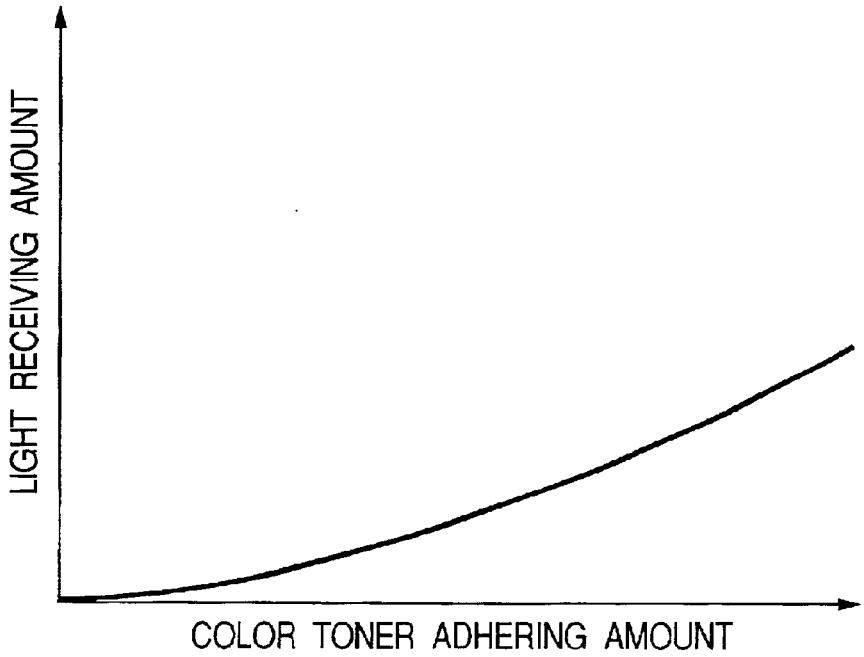
FIG. 3 shows the relationship between a light receiving amount and a color toner adhering amount in accordance with the embodiment of the present invention.
Figure 10:
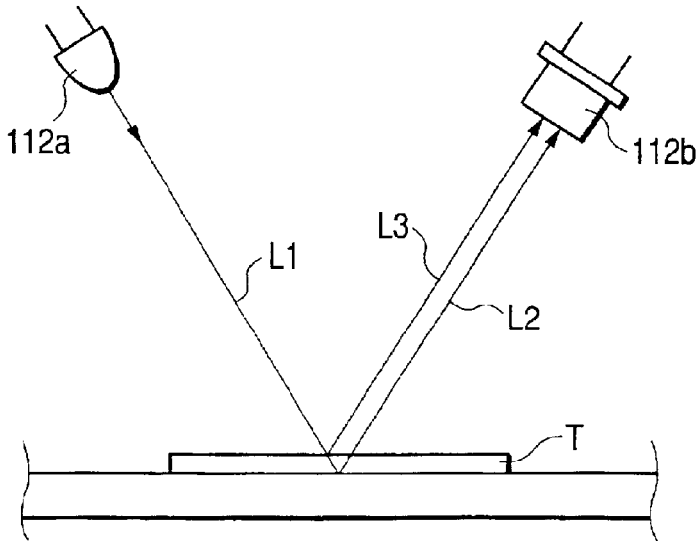
FIG. 10 is a schematic diagram in measurement of the color toner adhering amount by means of a density sensor.
Figure 11:
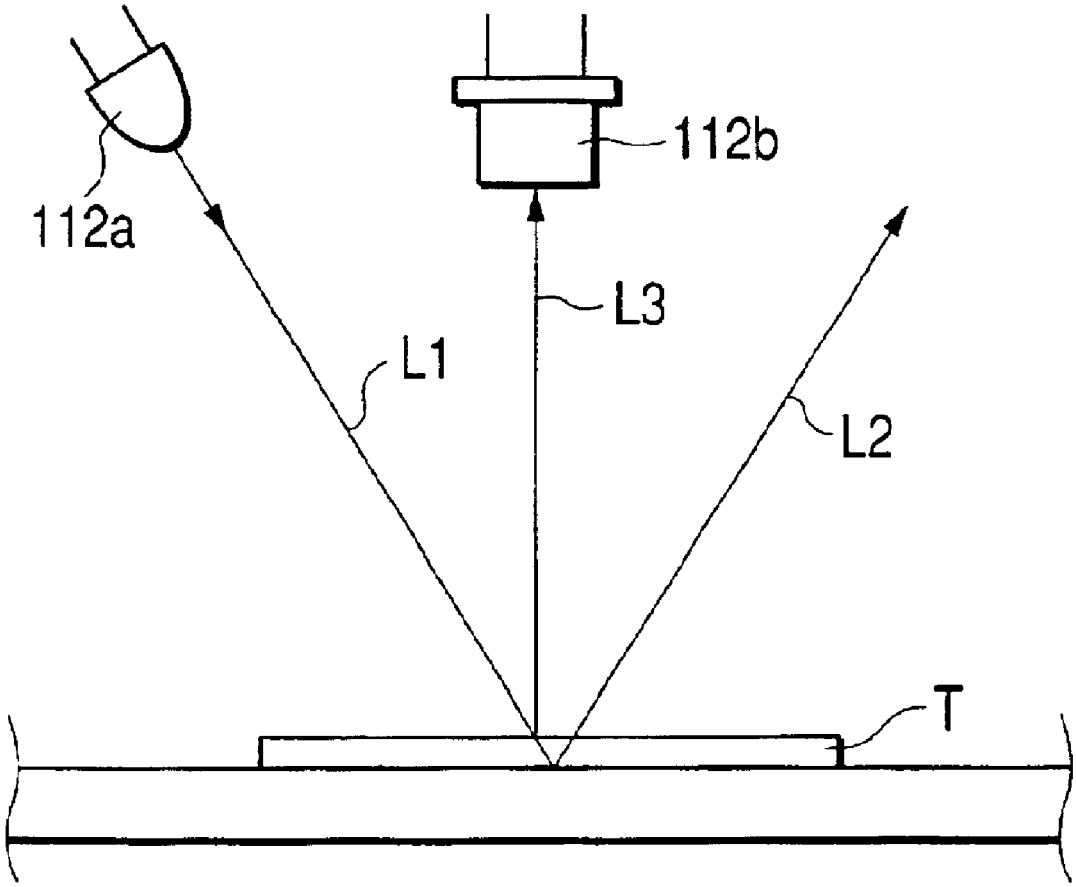
FIG. 11 is a schematic diagram in measurement of the color toner adhering amount by means of a density sensor.

Reference symbol 12*a* indicates a light emitting element such as LED as a light emitting means, and reference symbol 12*b* indicates a light receiving element such as a photodiode as a light receiving means. The light emitting element 12*a* and the light receiving element 12*b* are arranged to make the same angle to a surface of a patch T. When a measurement light from the light emitting element 12*a* is irradiated to the patch T, only a reflection light component L3 caused by the color toner patch Tc enters the light receiving element 12*b*. This is because the reflection light component L2 caused by the surface of the intermediate transfer belt 5*d* (see FIG. 10) is attracted by the base toner layer Tk of K and does not exist. Only the diffuse reflection light L3 is detected as an analog signal by the light receiving element 12*b*, and the signal that has undergone A/D conversion by an A/D conversion means is transmitted to a CPU and calculated (see FIG. 1). FIG. 3 shows a result of measurement of the color toner formed on the base toner layer Tk of K with the use of the density sensor 12. The horizontal axis indicates a color toner adhering amount, and the vertical axis indicates a light receiving amount. In accordance with this embodiment, the light receiving amount increases as the color toner adhering amount increases, and thus, the color toner adhering amount can be measured with accuracy.

The image density control of the black toner image is conducted as follows. The black toner image is directly formed without providing a base of the toner image on the intermediate transfer belt, and the light obtained from the black toner image (the reflection light L2 of the intermediate transfer belt) is detected by a detecting means.

As described above, the black toner layer is laid out as the base in the density detection of the color toner in this embodiment. As a result, the reflection light detected by the light receiving element is only the diffuse reflection component caused by the color toner, and the density can be detected with accuracy.

Incidentally, the light emitting element 12*a* and the light receiving element 12*b* are arranged so as to make the same angle to the surface of the patch T in order that a light receiving signal in the case where the patch toner does not exist at the time of measurement of the toner adhering amount of the K toner is obtained at the maximum level. However, in the case where the light receiving signal in the case where the patch toner does not exist on the intermediate transfer belt 5*d* is sufficiently obtained, namely, the case where the intermediate transfer belt 5*d* does not have a mirror surface and diffuses the measurement light that has entered the belt, the K toner adhering amount can be measured. Thus, the light receiving element 12*b* may be located at any position.

Next, another embodiment will be described.

Figure 4:
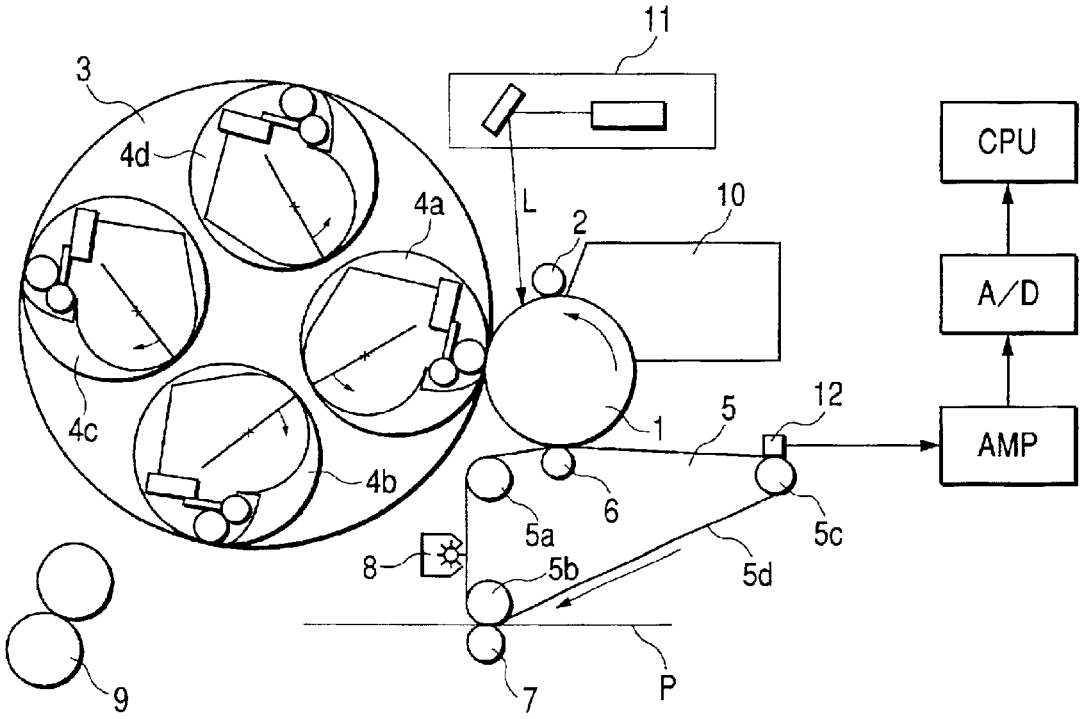
FIG. 4 is a sectional diagram of a color image forming apparatus in accordance with another embodiment of the present invention.

FIG. 4 is a sectional diagram of a color image forming apparatus in accordance with this embodiment. In FIG. 4, the components and the like with structures and actions which are similar to those in the embodiment of FIG. 1 are denoted by the same reference symbols, and a description therefor is appropriately omitted.

Figure 5:
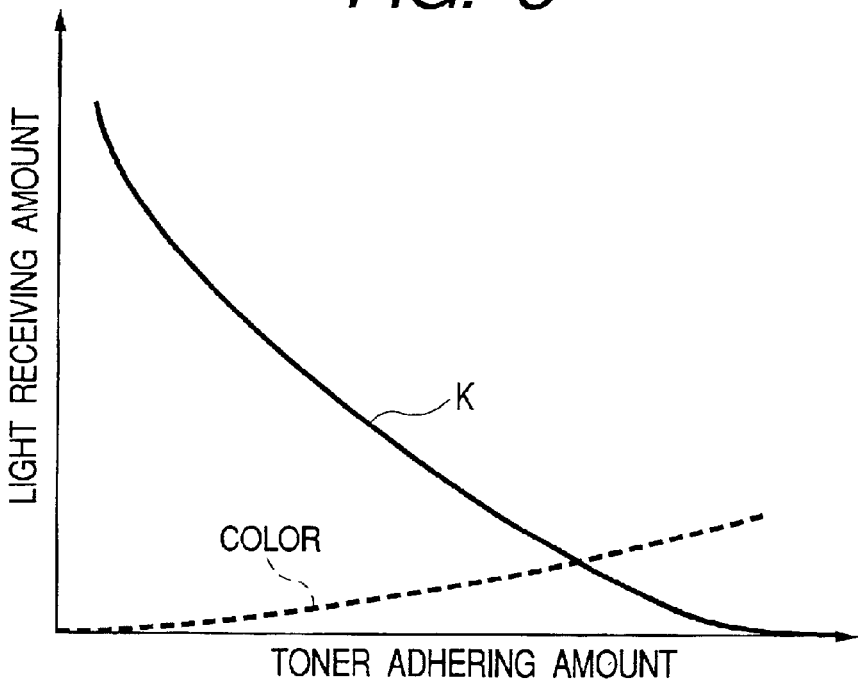
FIG. 5 shows the relationship between a light receiving amount and a toner adhering amount in accordance with the embodiment of the present invention.

FIG. 5 shows the relationship between the light receiving amount of the light receiving element 12*b* and the toner adhering amount in the embodiment in FIG. 1. A solid line indicates the light receiving amount in the K toner, and a broken line indicates the light receiving amount in a color toner. In the measurement of the K toner, it is understood that the reflection light amount in case of zero of the toner adhering amount, namely the reflection light amount from only the intermediate transfer belt 5*d* is largest. Further, it is seen that, in comparison with a width in change of the light receiving amount due to the increase and decrease of the K toner adhering amount, namely, an S/N ratio, the S/N ratio due to the increase and decrease of the color toner adhering amount is small. When the signal of the light receiving amount as shown in FIG. 5 is subjected to A/D conversion, a quantization error increases, which leads to deterioration of detection accuracy in case of the color toner. Thus, an amplifier (Amp) is provided before an analog signal of the light receiving amount is converted into a digital one in this embodiment. When the color toner patch is formed on the base of the K toner and then the image density control is conducted as in Embodiment 1, a signal amplification factor is changed between the K toner and the color toner. That is, the amplification factor is not made so large at the time of measurement of the K toner density while the amplification factor is made large at the time of measurement of the color toner density. From this, the quantization error in the A/D conversion becomes small also in the color toner, and the image density control can be performed with high precision.

The reflection light that enters the light receiving element at the time of detection of the color toner image is weaker than that at the time of detection of the K toner image. Thus, the signal is amplified by the amplifier, thereby being capable of improving the detection accuracy.

Subsequently, still another embodiment will be described with reference to FIGS. 12A and 12B.

Figure 12A:
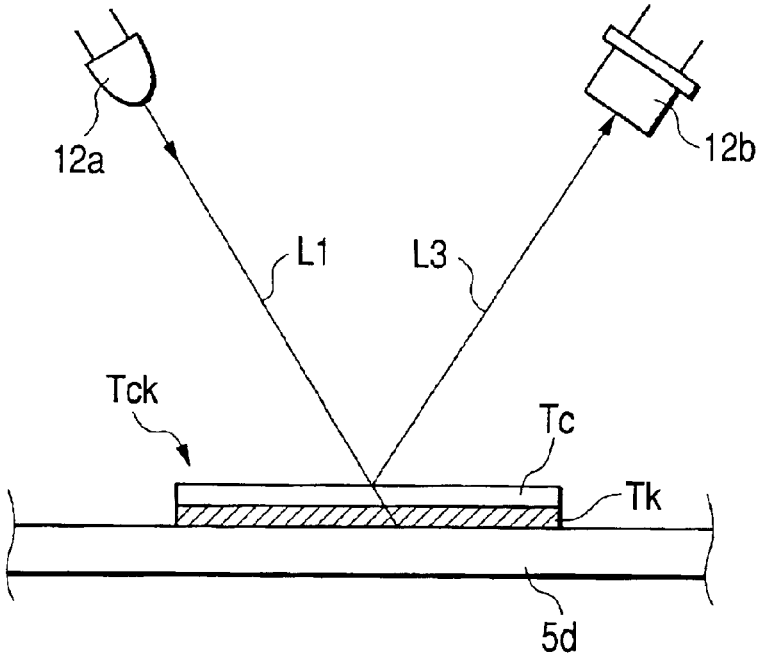
FIGS. 12A and 12B are schematic diagrams in measurement of a toner adhering amount by means of a density sensor in accordance with still another embodiment of the present invention.
Figure 12B:
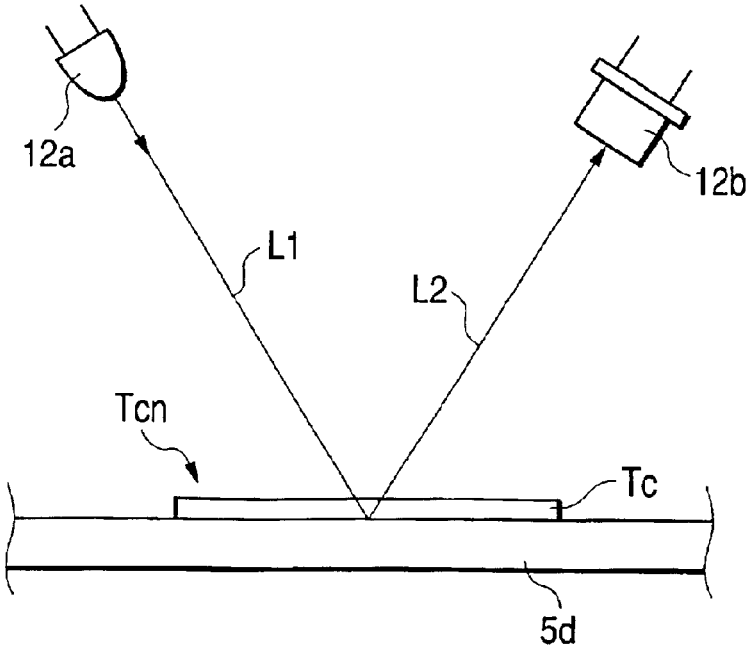

In FIGS. 12A and 12B, the components and the like with structures and that are similar to those in the above-described embodiments, are denoted by the same reference symbols, and description thereof, are appropriately omitted.

Figure 6:
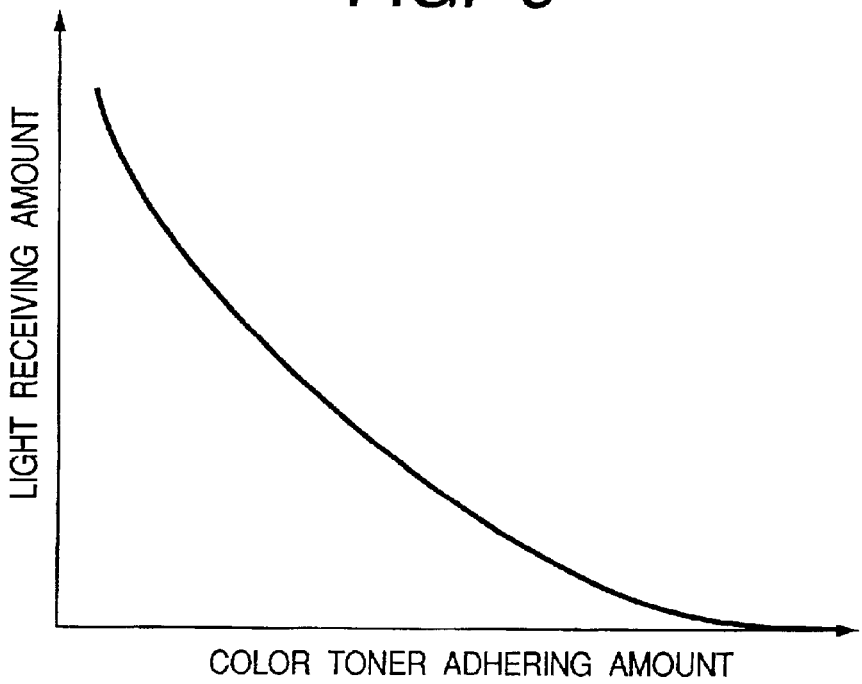
FIG. 6 shows the relationship between a light receiving amount and a color toner adhering amount in accordance with an embodiment of the present invention.
Figure 7:
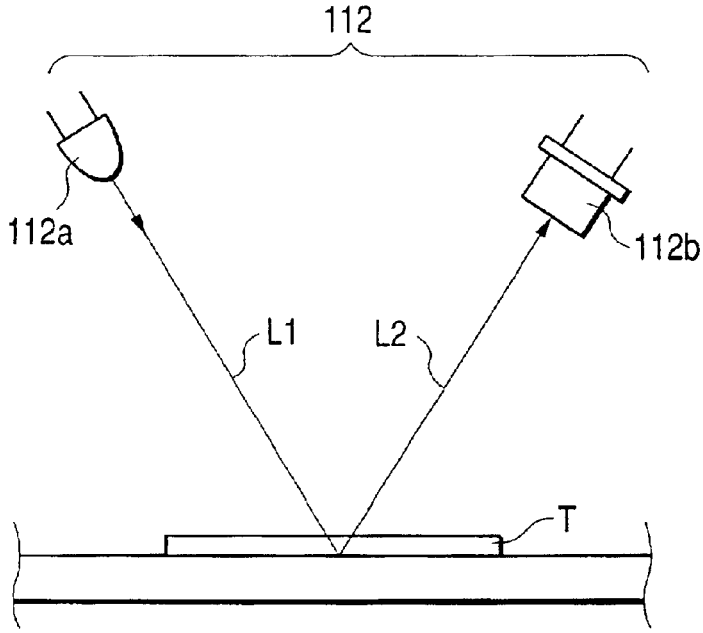
FIG. 7 is a schematic diagram in measurement of a toner adhering amount by means of a density sensor.
Figure 8:
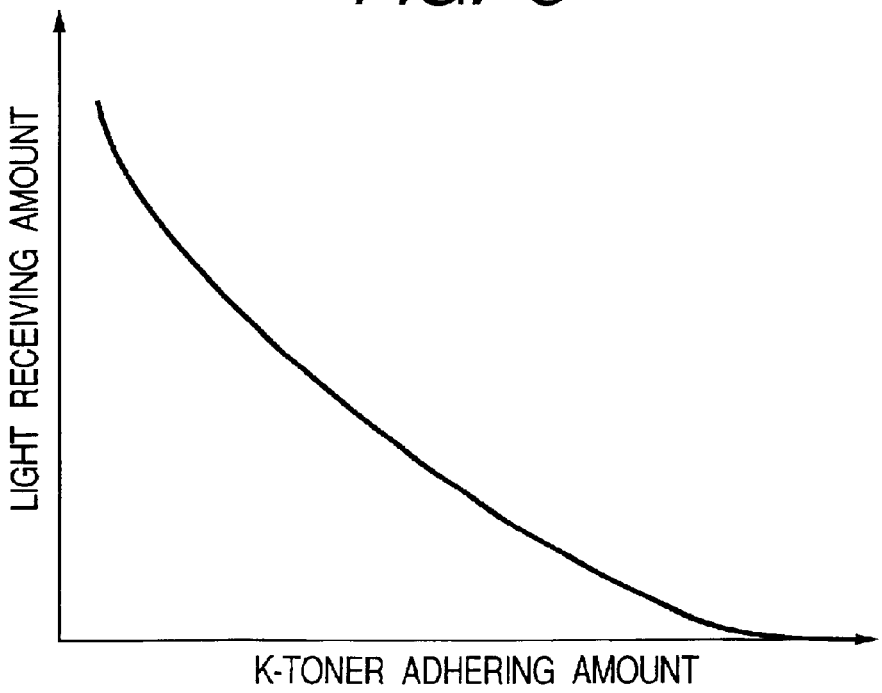
FIG. 8 shows the relationship between a light receiving amount and a black toner adhering amount.
Figure 9:
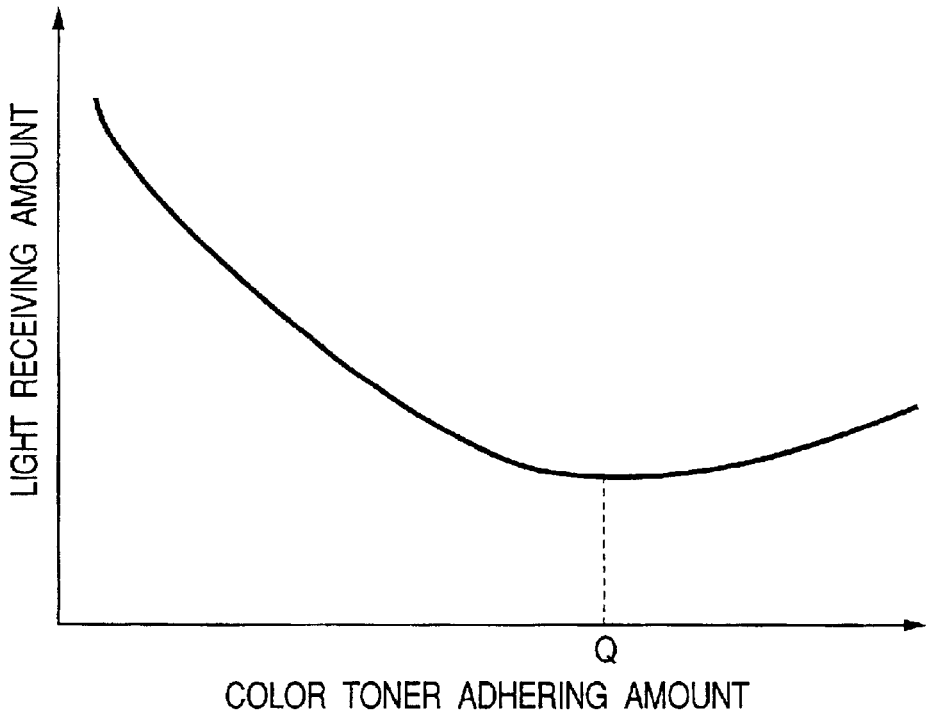
FIG. 9 shows the relationship between a light receiving amount and a color toner adhering amount.

When the patch Tc of the color toner is formed, a plurality of patches in the case Tck where the K toner as the base exists as in the above-described embodiment and the case Tcn where the base does not exist are formed under the same conditions except whether the K toner as the base exists or not, and the image density control to Tcn and the image density control to Tck are performed. Then, a light receiving signal output of Tck becomes an output of only the reflection light L3 from the color toner portion due to the effect of the K toner base. A light receiving signal output of Tcn becomes an output in which the reflection light L2 from the intermediate transfer belt 5*d* and the reflection light L3 from the color toner portion are mixed. What is obtained by subtracting the light receiving signal output of Tck from the light receiving signal output of Tcn is regarded as a signal of the patch Tc. Thus, the reflection light component L3 from the color toner portion is cancelled, and only the reflection light component L2 is detected from the intermediate transfer belt 5*d* as in the case of the K toner. FIG. 6 shows the relationship of the signal output after the calculation in this embodiment. As seen from FIG. 6, the more the amount of the color toner attached to the surface of the intermediate transfer belt 5*d* increases, the smaller the light receiving signal is, and substantially the same curve as in the case of the K toner is formed. That is, a sufficient S/N ratio can be secured even if the amplification factor is not changed between the K toner and the color toner by specially using the amplifier. Accordingly, the image density control can be performed with high accuracy.

As in this embodiment, the difference between the light receiving signal of the reflection light in the case where the K toner is not laid out as the base and the light receiving signal of the reflection light in the case where the K toner is laid out is obtained to thereby remove the reflection component caused by the color toner, whereby the detection accuracy is also improved.

Although the case where the intermediate transfer belt is adopted as the toner image bearing member is described in this embodiment, the case where an intermediate transfer drum is adopted as the image bearing member is also applied. Further, in case of adopting the image on image development method, the same effect can be obtained also in the case where a photosensitive member is adopted as the image bearing member and the image density control is performed on the photosensitive member. Of course, in case of adopting the electrostatic transfer member method, the same effect can be naturally obtained also when an electrostatic transfer belt or an electrostatic transfer drum is adopted as the image bearing member and the image density control is performed on the electrostatic transfer belt or the electrostatic transfer drum.

Next, a description will be made of the case where the image bearing member is black or dark gray.

Figure 13:
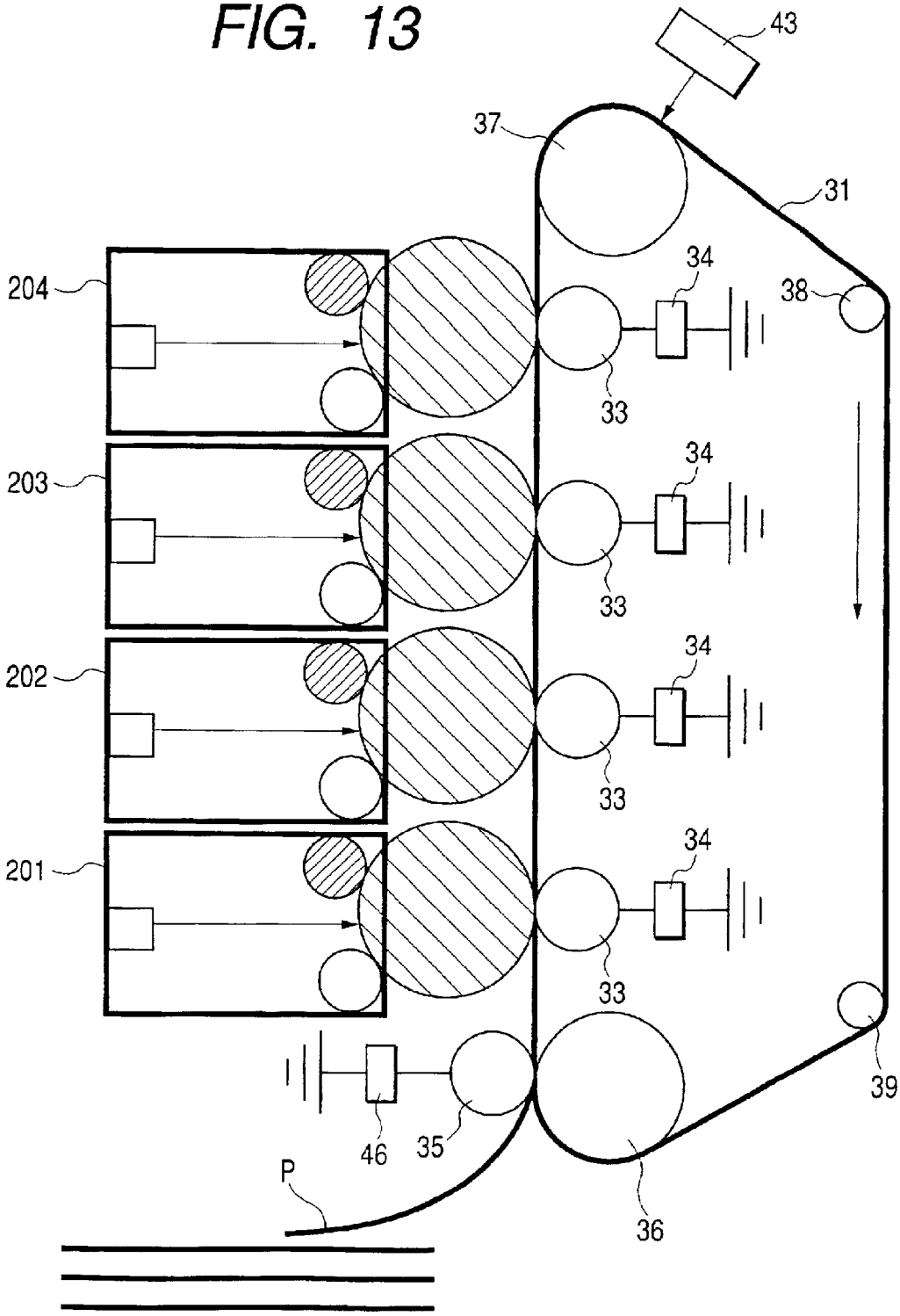
FIG. 13 shows a structure of an in-line type image forming apparatus in accordance with still another embodiment of the present invention.

FIG. 13 shows the structure of an in-line type image forming apparatus. In FIG. 13, an electrostatic attractive conveying belt (hereinafter referred to as ETB) 31 is tensioned by a driver roller 37, an attractive opposing roller 36 and tension rollers 38 and 39, and rotates in a direction indicated by an arrow in the figure. For the ETB 31, there is used a resin film, such as PVdF, ETFE, polyimide, PET or polycarbonate, approximately with a thickness of 50 to 200 $\mu$m and a volume resistivity of $10^{-9}$ to $10^{-16}$ Ωcm or the resultant obtained by forming urethane rubber dispersed with fluorine resin such as PTFE, for example, which is a surface layer, on a base layer of, for example, rubber such as EPDM, with a thickness of approximately 0.5 to 2 mm.

On the peripheral surface of the ETB 31, process stations 201 (black), 202 (magenta), 203 (yellow) and 204 (cyan) for different colors are arranged in line, and a photosensitive member in each process station is made into contact with a transfer roller 33 through the ETB 31. Further, an attractive roller 35 is arranged upstream of the process stations 201 to 204, and is made into contact with the attractive opposed roller 36 though the ETB 31. Here, the transfer material P is applied with a bias by a bias power source 46 when passing through a nip portion formed by the attractive roller 35 and the attractive opposed roller 36. The transfer material P is electrostatically attracted by the ETB 31 and conveyed in a direction indicated by an arrow.

Here a description is made of an image forming process. First, the image forming process in each of the process stations 201 to 204 is described. The description is made using the process station 201 for yellow, but is also applied to the stations for other colors.

Figure 14:
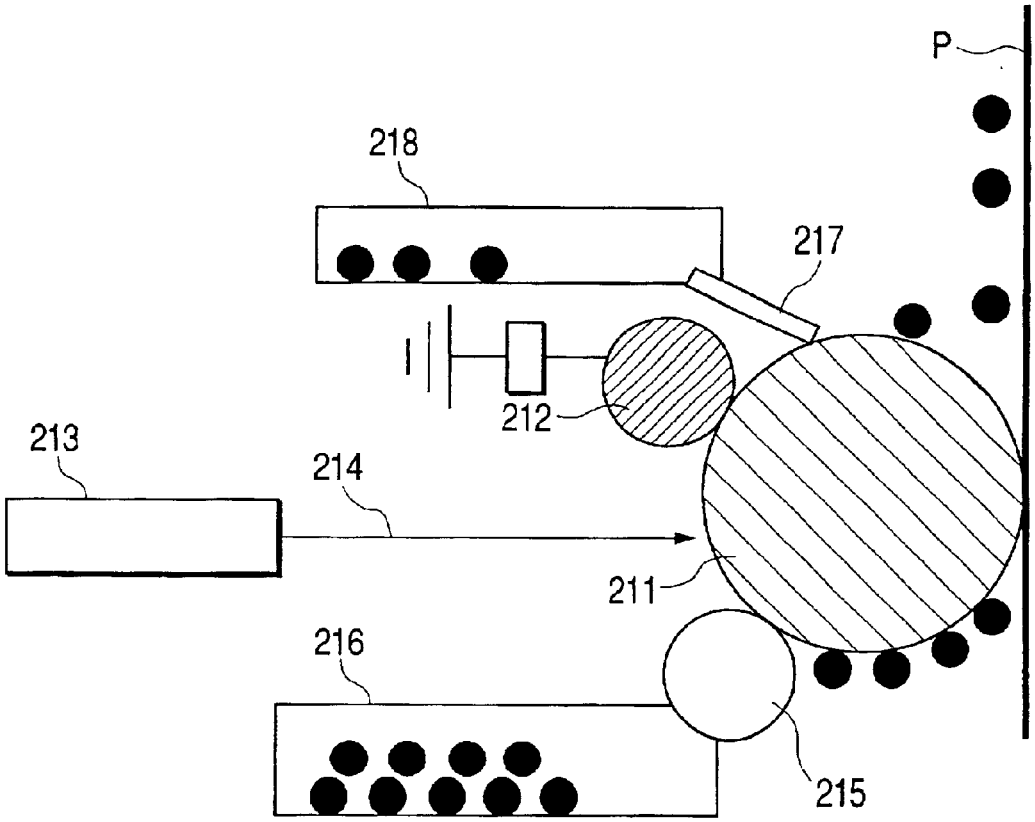
FIG. 14 shows a structure of a process station.

FIG. 14 shows a structure of the process station. A photosensitive member 211 is uniformly charged by a charger 212, and a latent image is formed by a scanning light 214 from an exposure optical system 213. The latent image is developed by a developing roller 215 by using a toner in a toner container 216, and a toner image is formed on the photosensitive member 211. A transfer residual toner that has not been transferred by a transfer process described later is scraped off by a cleaning blade 217 and held in a waste toner container 218.

Next, the transfer process is described. In a reversal developing method generally used, in the case where the photosensitive member is, for example, an OPC photosensitive member with negative polarity, a negative polarity toner is used in developing of an exposure portion. Therefore, a positive polarity transfer bias is applied to the transfer roller 33 from a bias power source 34. Here, a low resistance roller is generally used as the transfer roller 33.

In an actual printing process, taking a passing speed of the ETB 31 and the distance between transfer positions of the process stations 201 to 204 into consideration, the image formation in the process station, the transfer process and the conveyance of the transfer material P are conducted with the timing that the positions of the toner images of the respective colors formed on the transfer material P coincide with each other, and the toner images are completed on the transfer material P while the transfer material P passes the process stations 201 to 204 once. After completed on the transfer material P, the toner images are fixed when the transfer material P is passed through a fixing device (not shown). When the above-described process is completed, the ETB 31 is charge-eliminated by a not-shown charge eliminating charger, and provides for the next printing process.

Incidentally, the image density fluctuates in accordance with a temperature and relative humidity condition under the use of the image forming apparatus or a usage degree of the process station. The image density control is performed in order to correct the fluctuation. Here, the image density control is described.

In the image density control, density patch images (detection patterns) of respective colors are formed on a photosensitive member, an intermediate transfer member (hereinafter referred to as ITB) or an ETB as a detection pattern bearing member, are read by a density detection sensor, and are fed back to process forming conditions such as a high voltage and laser power, whereby the maximum densities and halftone gradation characteristics of the respective colors are made to coincide with each other. In the density detection sensor, in general, a density patch is irradiated with a light source, and a reflection light intensity is detected by a light receiving sensor. A signal of the reflection light intensity undergoes A/D conversion, is processed by a CPU, and is fed back to the process forming conditions.

The image density control has the aim of constantly maintaining the maximum densities of the respective colors (hereinafter referred to as Dmax control) and the aim of maintaining the halftone gradation characteristics in a linear state to an image signal (hereinafter referred to as Dhalf control).

The Dmax control constantly maintains the color balance between the respective colors and also has the importance of prevention of scatters of letters in which colors are superimposed due to over-taking of a toner and prevention of poor fixation. Specifically in the Dmax control, a plurality of density patches formed while changing image forming conditions are detected by an optical sensor 43 (refer to FIG. 13), and the conditions with which a desired maximum density can be obtained are calculated from the result, thereby changing the image forming conditions. Here, it is preferable in many cases that the density patch is formed in halftone. The reason for this is that in the case where a so-called solid image is detected, the width in change of the sensor output to the change of the toner amount is small, and thus, sufficient detection accuracy cannot be obtained.

On the other hand, in the Dhalf control, in order to prevent that a natural image is not formed by fluctuation of an output density to an input image signal due to a nonlinear input/output characteristic peculiar to electrophotography ($\gamma$-characteristic), image processing is conducted such that the $\gamma$-characteristic is cancelled to maintain the input/output characteristic in a linear state. Specifically, a plurality of density patches with different input image signals are detected by an optical sensor to obtain the relationship between the input image signal and the density. Based on the relationship, the image signal input to the image forming apparatus is converted by a controller of the image forming apparatus so as to obtain a desired density to the input image signal from a host computer. The Dhalf control is generally conducted after the image forming conditions are determined by the Dmax control.

The density patch formed on the ETB is electrostatically collected in a process means by a cleaning process. At the time of cleaning process, a bias having the opposite polarity to the charge polarity of the toner is applied to the photosensitive member, the toner is attracted to the photosensitive member by a transfer portion, and the toner is scraped off by the cleaning blade 217 similar to the transfer residual toner.

As described above, generally in the density detection sensor, the light source irradiates the density patch, and the light receiving sensor detects the reflection light intensity. Methods of the density detection sensor can be roughly divided into methods of detecting a diffuse reflection component of a reflection light and methods of detecting a regular reflection component of a reflection light.

Figure 15:
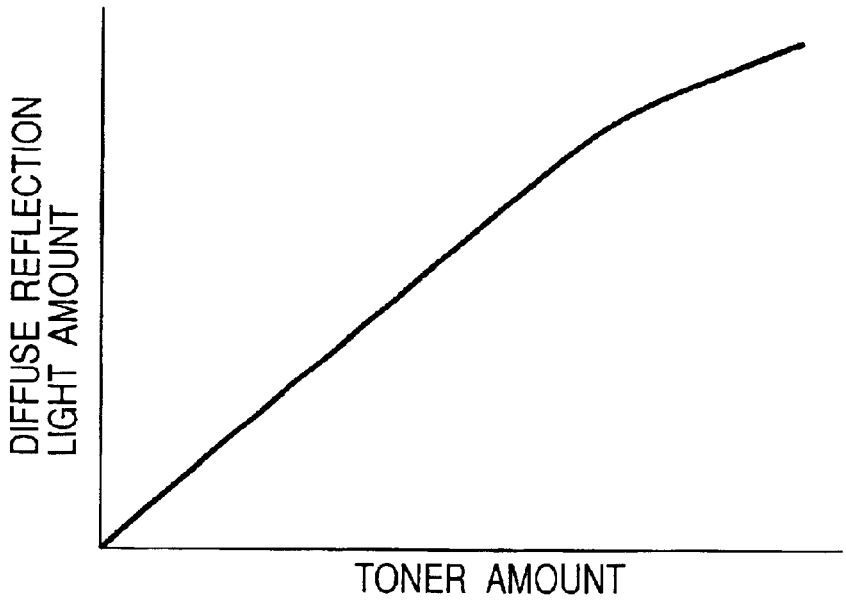
FIG. 15 shows the relationship between a toner amount and a diffuse reflection light amount.
Figure 16:
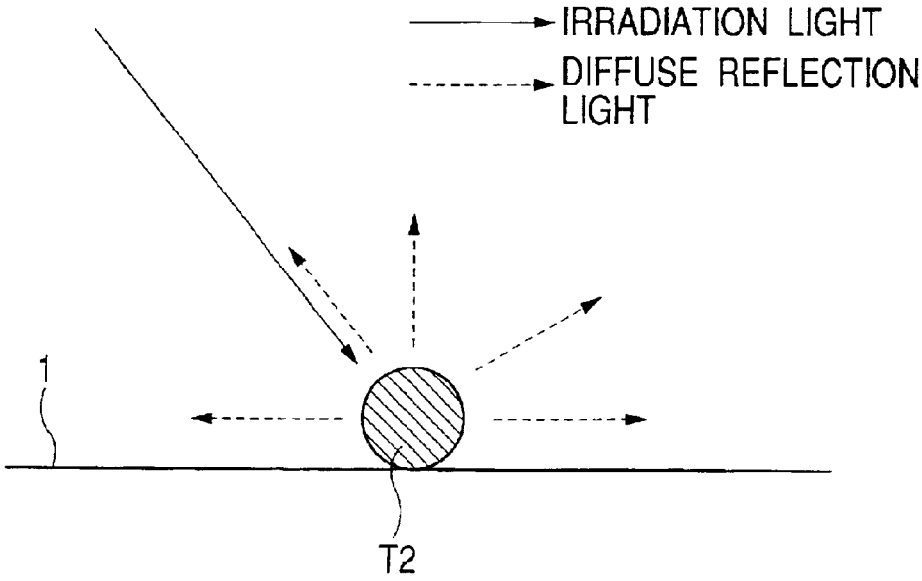
FIG. 16 is a diagram explaining reflection of light irradiated to a chromatic color toner.
Figure 17A:
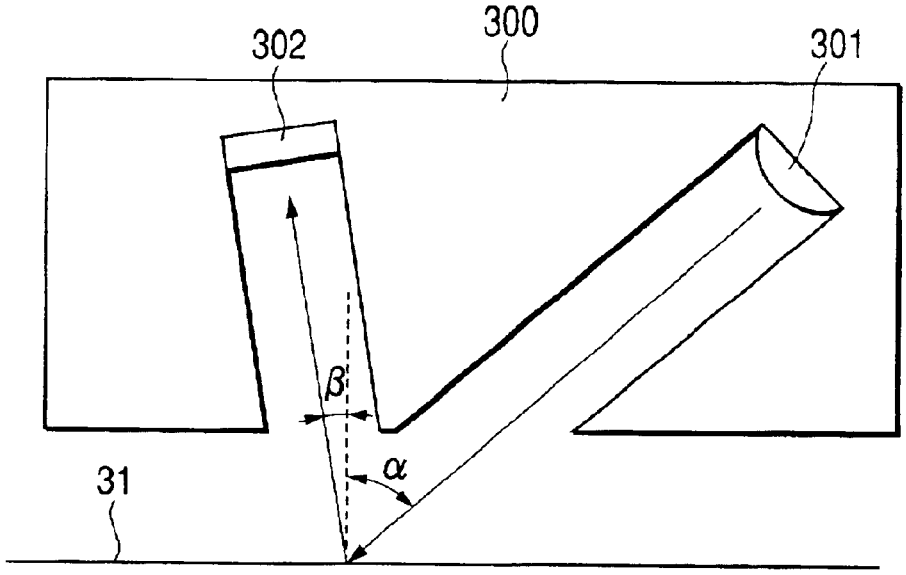
FIGS. 17A and 17B are diagrams explaining structures of optical sensors.

First, the method of detecting a diffuse reflection component is described in detail. The diffuse reflection component is a reflection component perceived as a color, and has a characteristic that the reflection light amount increases in accordance with the increase in the color material amount of the density patch, that is, the toner amount as shown in FIG. 15. Further, the diffuse reflection component also has a characteristic that the reflection light of a toner T2 of a chromatic color diffuses from the density patch in all directions as shown in FIG. 16. Therefore, as shown in FIG. 17A, in an optical sensor 300 of a type for detection of the diffuse reflection component, a light emitting element 301 and a light receiving element 302 are arranged such that an irradiation angle $\alpha$ and a light receiving angle $\beta$ are different from each other in order to eliminate the influence of the regular reflection component described later.

In the case where an in-line type image forming apparatus having a plurality of photosensitive members is used as described in the above-described technique, it can be considered that the formation and detection of the density patches are not conducted on the photosensitive member in order to reduce the number of optical sensors and that the density patches are formed on the ETB or ITB and detected by one optical sensor with respect to all colors. However, it is preferable for the ETB or ITB that adjustment of a resistance value is performed to secure a sheet conveying force and image stability on the ITB. Thus, the ETB or ITB is dispersed with carbon black so that the ETB or ITB is often black or dark gray. Therefore, in the case where the density of the black toner is detected on the ETB or ITB, the diffuse reflection light is reflected from neither the density patch nor the base, and thus, the optical sensor of a type for detection of the diffuse reflection cannot detect the black toner. In order to solve this problem, there has been devised a method in which a density patch of a black toner is formed on a chromatic color image, and a decrement of the diffuse reflection component is detected to detect the black toner density, as disclosed in U.S. Pat. No. 5,103,260. However, from the viewpoint of detection ability of a highlight region sensitive to a visual characteristic of a human being and of detection accuracy due to the difference of the maximum reflection light intensity, it is preferable that the optical sensor of a type for detection of a regular reflection light which is described later is used.

Figure 17B:
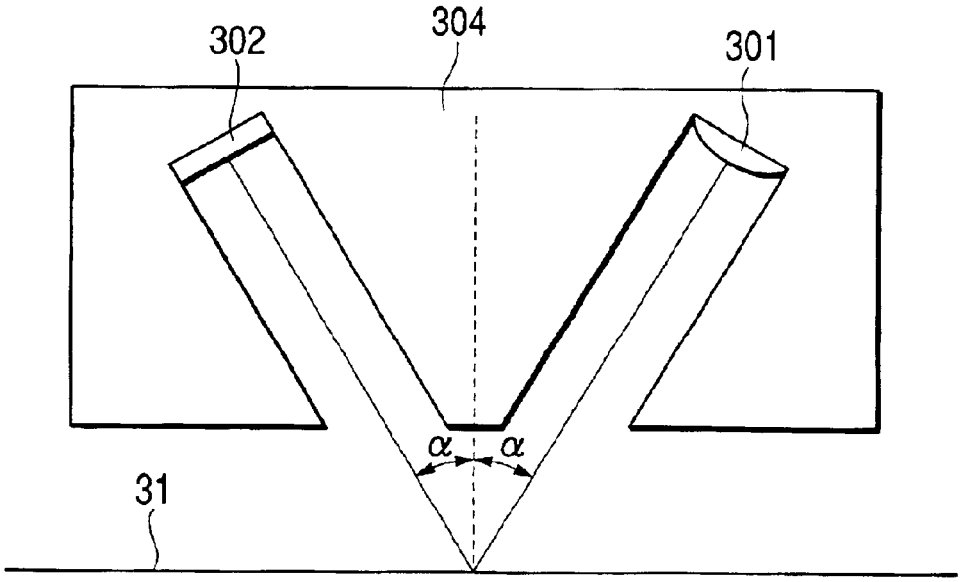

Then, the method of detecting a regular reflection component of a reflection light is described in derail. In an optical sensor 304 of a type for detection of the regular reflection light, as shown in FIG. 17B, the light emitting element 301 and the light receiving element 302 are arranged so as to detect the light reflected in directions symmetrical with respect to a normal line of the base surface (surface of the ETB 31) at the irradiation angle α. The reflection light amount depends on the reflectance determined by a refractive index peculiar to the material of the base (ETB) and the surface state, and is perceived as luster. The reflection light amount becomes maximum in the case where the toner does not exist on the base. In the case where the density patch is formed on the base, the base is covered and the reflection light does not exist at the portion where the toner exists. Therefore, the reflection light amount becomes smaller along with the increase of the toner amount of the density patch.

The optical sensor of the type for detection of the regular reflection light mainly detects not the reflection light from the toner but the reflection light from the base, and thus can conduct density detection irrespective of the color of the toner and the base. The optical sensor is therefore more effective than the optical sensor of the type for detection of the diffuse reflection light. Further, the reflection light amount of the regular reflection component is generally larger than the reflection light amount of the diffuse reflection component, and the optical sensor of the type for detection of the regular reflection light is more advantageous also as to the detection accuracy of the optical sensor. Therefore, it is preferable that the optical sensor of the type for detection of the regular reflection light is used also in the case where density detection is performed on the photosensitive member.

In the optical sensor of the type for detection of the regular reflection light, the reflection light amount also fluctuates in the case where the base surface state fluctuates in accordance with the degree of the usage. Thus, it is effective that after the reflection light amount of the density patch is standardized based on the reflection light amount of the base, the resultant is subjected to correction such as conversion into density information.

However, a problem arises in the case where the optical sensor of the type for detection of the regular reflection light detects a chromatic color toner. In the case where light is irradiated to the density patch of the chromatic color toner, the diffuse reflection light increases along with the increase of the toner amount, the reflection light diffuses uniformly in all directions as described above, and thus, the light detected by the optical sensor is the sum of the regular reflection component and the diffuse reflection component. Therefore, the linearity necessary for density detection cannot be obtained, and density detection accuracy is not sufficient.

In order to solve the problem described above, there have been devised a method in which: both an optical sensor or light receiving element for detecting diffuse reflection and an optical sensor or light receiving element for detecting regular reflection are provided; and a chromatic color toner and a black toner are detected with respect to a diffuse reflection component and a regular reflection component, respectively, as disclosed in JP 5-249787 A, and a method in which: a polarizing plate is provided before a light emitting element and a light receiving element; and the difference of a polarization characteristic between a diffuse reflection component and a regular reflection component is utilized to extract only the regular reflection component, as disclosed in JP 6-250480 A. However, any of the methods leads to the increase of cost of the optical sensor.

Embodiments are described below with an object to provide an image forming apparatus in which density detection of a chromatic color toner can be performed with accuracy by means of a regular reflection detection type optical sensor having a simpler structure.

Figure 18B:
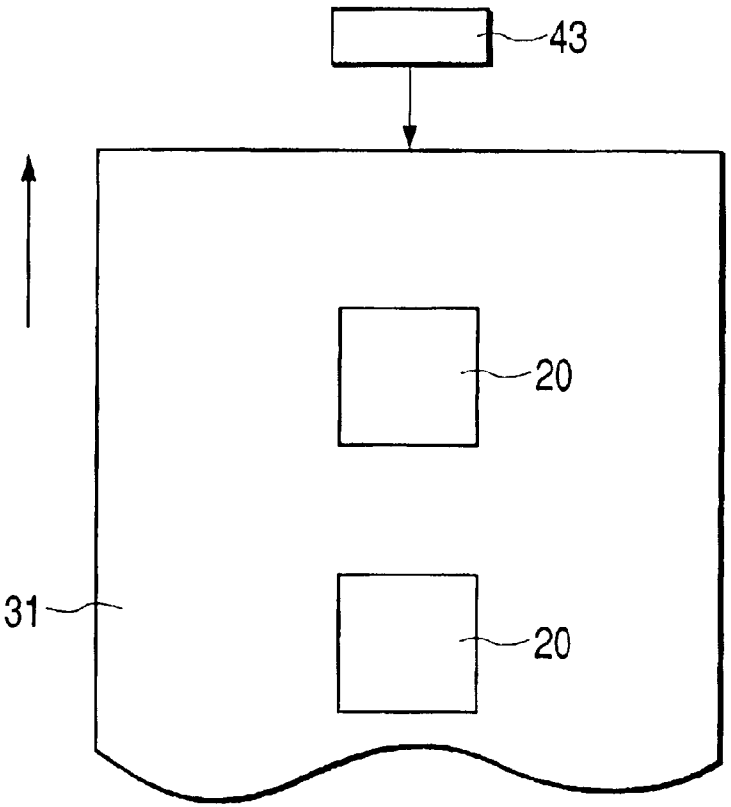
FIGS. 18A and 18B are diagrams explaining operations of an image forming apparatus in accordance with still another embodiment of the present invention.
Figure 18A:
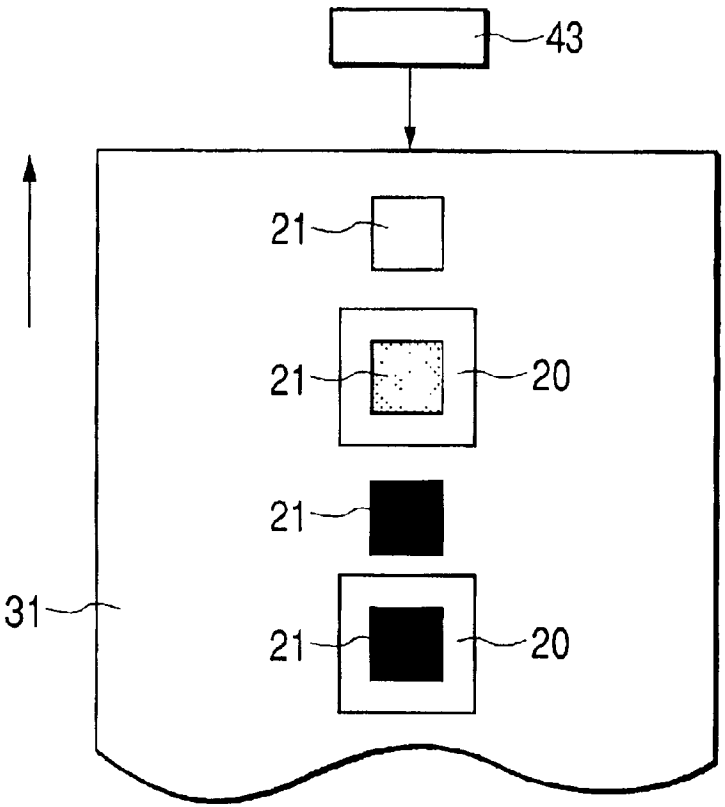
Figure 19:
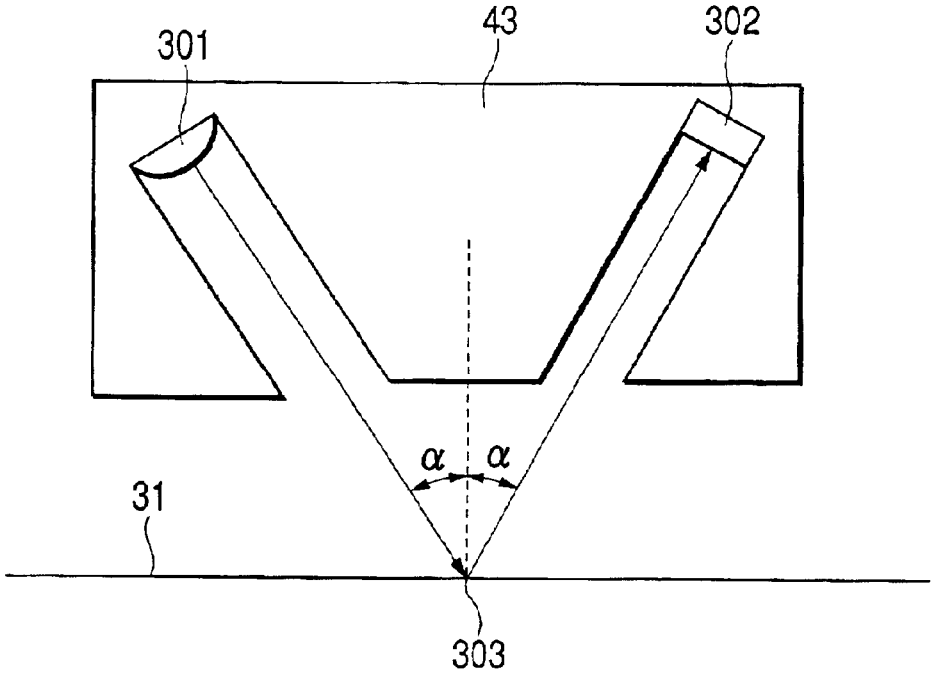
FIG. 19 is a diagram explaining a structure of an optical sensor for detecting a regular reflection light.
Figure 20:
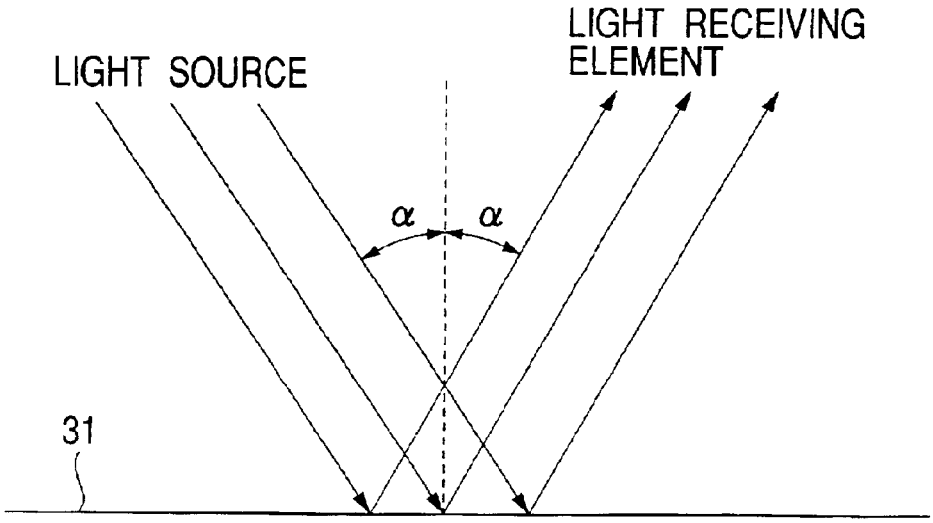
FIG. 20 is a diagram explaining states of an irradiation light and a regular reflection light.
Figure 21:
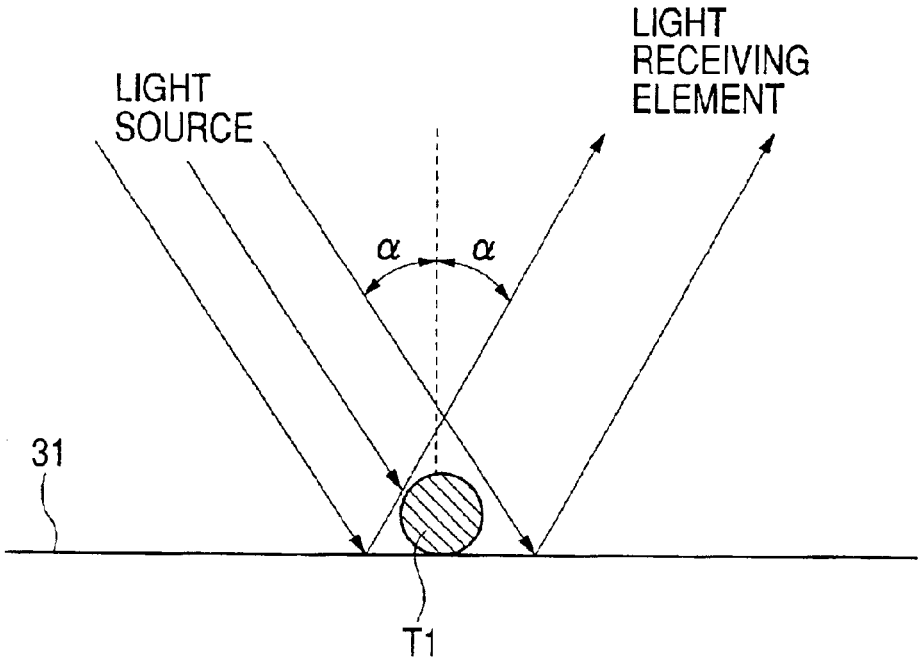
FIG. 21 is a diagram explaining states of an irradiation light and a regular reflection light in the case where a toner exists on an ETB.
Figure 22:
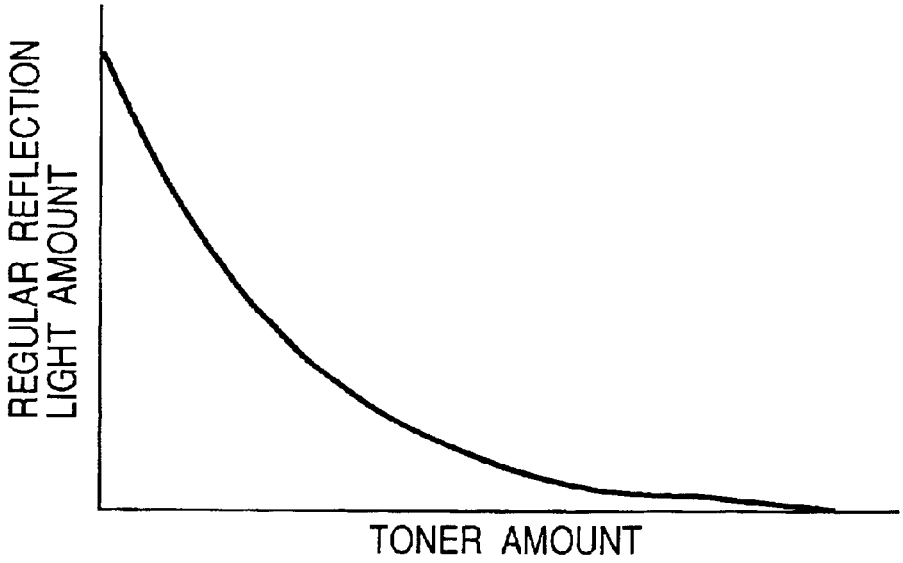
FIG. 22 is a diagram explaining the relationship between a toner amount and a regular reflection light.
Figure 23:
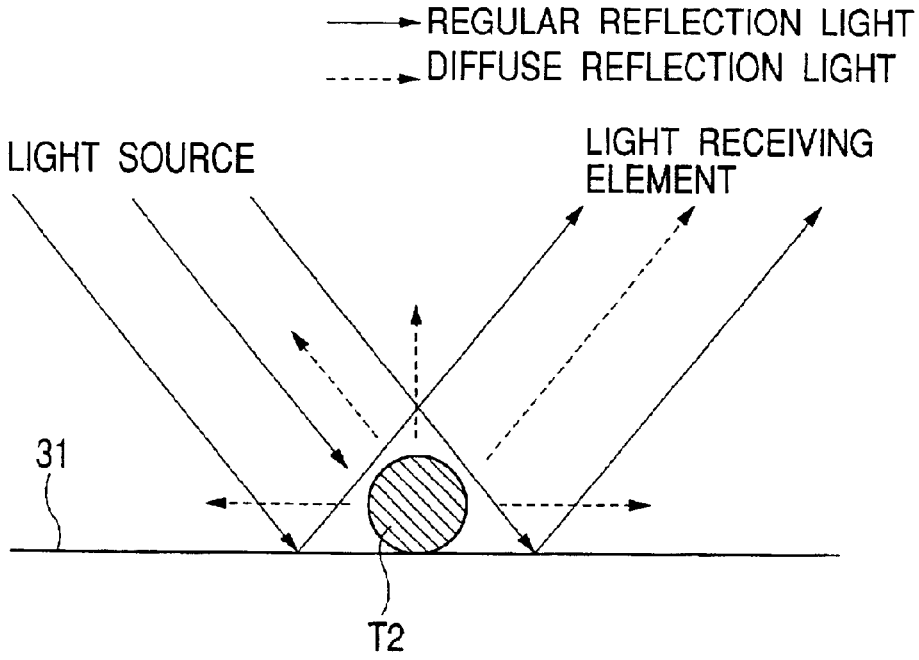
FIG. 23 is a diagram explaining the relationship between an irradiation light and a reflection light in the case where a chromatic color toner is detected.
Figure 24:
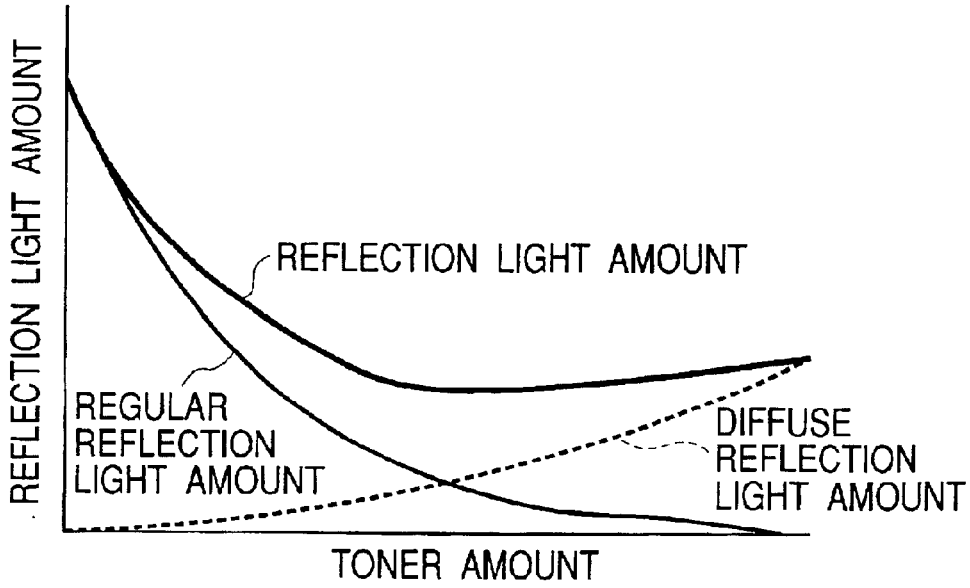
FIG. 24 is a diagram explaining the relationship between a toner amount and a reflection light in the case where a chromatic color toner is detected by a regular reflection light detection type optical sensor.
Figure 25:
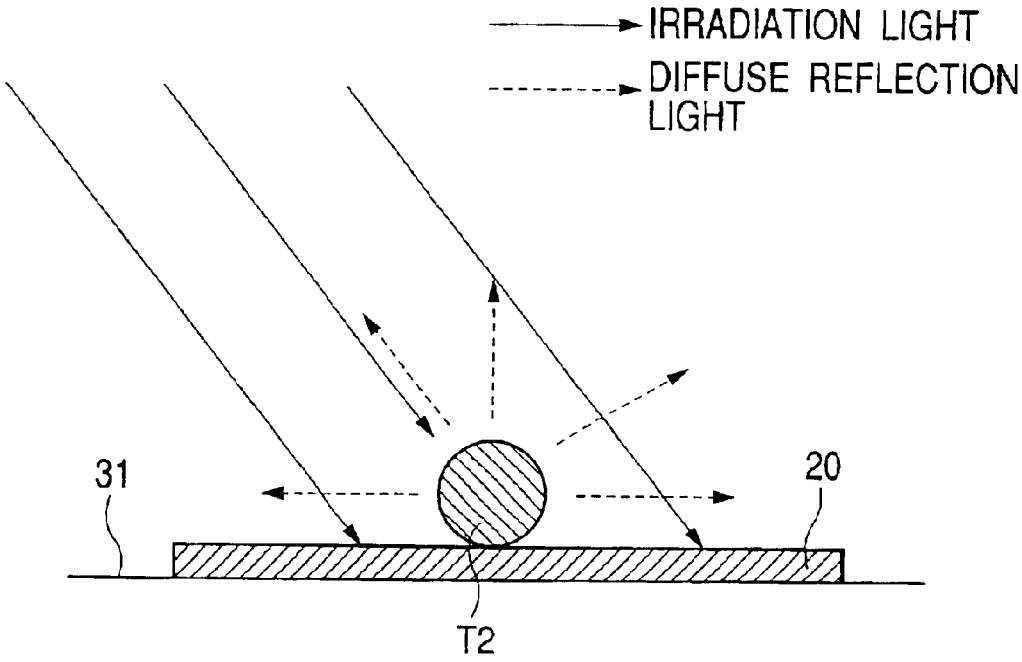
FIG. 25 shows the relationship between a density patch on a black solid image and a reflection light.
Figure 26:
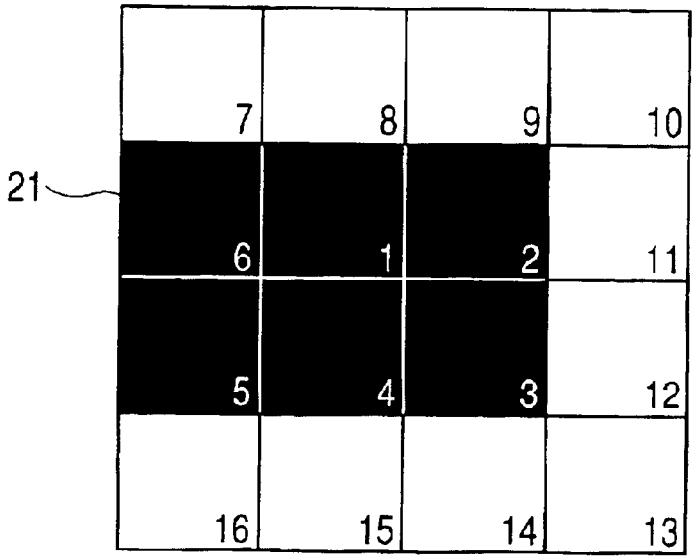
FIG. 26 is a diagram explaining a density patch used in image density control.
Figure 27:
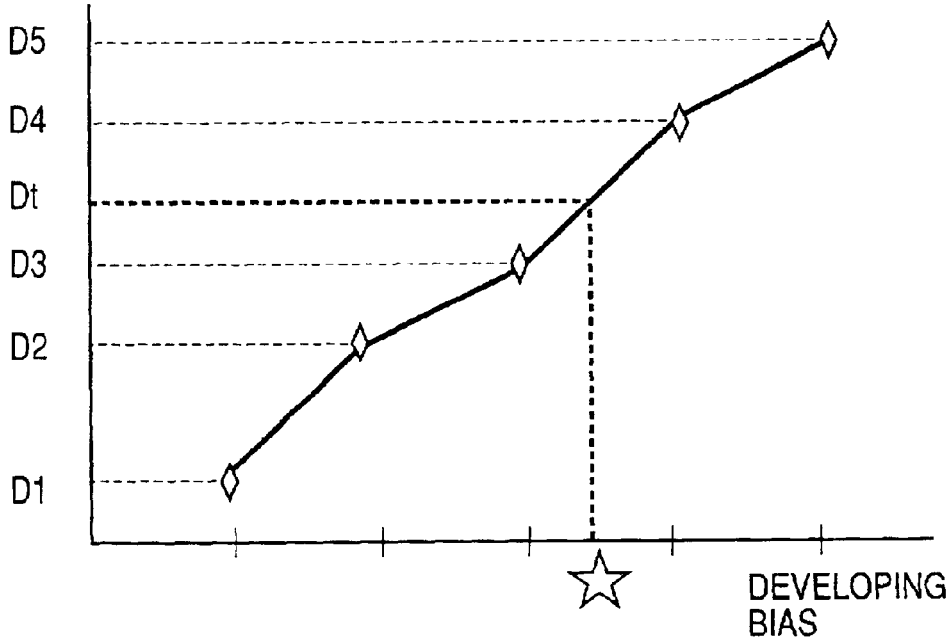
FIG. 27 is a diagram explaining a method of calculating the optimum developing bias.

An image forming apparatus in accordance with an embodiment of the present invention is described with reference to the accompanying drawings. FIGS. 18A and 18B are diagrams explaining operation of the image forming apparatus in accordance with this embodiment. FIG. 19 is a diagram explaining a structure of an optical sensor for detecting a regular reflection light. FIG. 20 is a diagram explaining states of an irradiation light and a regular reflection light. FIG. 21 is a diagram explaining states of the irradiation light and the regular reflection light in the case where a toner exists on an ETB. FIG. 22 is a diagram explaining the relationship between the toner amount and the regular reflection light. FIG. 23 is a diagram explaining the relationship between the irradiation light and the reflection light in the case where a chromatic color toner is detected. FIG. 24 is a diagram explaining the relationship between the toner amount and the reflection light in the case where the chromatic color toner is detected by a regular reflection light detection type optical sensor. FIG. 25 is a diagram explaining the relationship between a density patch on a black solid image and the reflection light. FIG. 26 is a diagram explaining a density patch used in image density control. FIG. 27 is a diagram explaining a method of calculating the optimum developing bias. The overall structure of the image forming apparatus is similar to that in FIG. 13. Thus, parts that overlap those in FIG. 13 are denoted by the same reference symbols and a description therefor is omitted. The characteristic parts in this embodiment are described.

In this embodiment, as the ETB 31 (electrostatic attractive conveying belt) serving as the detection pattern bearing member, a resin film of PVdF with a peripheral length of 800 mm and a thickness of 100 μm is used. In this embodiment, the optical sensor 43 (see FIG. 13) is composed of the light emitting element 301 such as the LED and the light receiving element 302 such as the photodiode as shown in FIG. 19. The light emitting element 301 and the light receiving element 302 are arranged so as to detect the regular reflection light. Specifically, the irradiation light from the light emitting element 301 enters the ETB 31 at an angle α (for example, α=30°) and is reflected at a detection position 303. The light receiving element 302 is provided at a position for detecting the reflection light reflected at the same angle α as that of the irradiation light of the reflection light. The optical sensor 43 used in this embodiment has a characteristic that a voltage becomes higher as the reflection light intensity becomes stronger.

The optical sensor 43 is used in the image density control for constantly maintaining the maximum densities of the respective colors, in order to detect a plurality of density patches (detection patterns) formed with different image forming conditions, to calculate the conditions with which a desired maximum density can be obtained from the result, and to change the image forming conditions, as described above.

The characteristic of the reflection light detected at the time of detection of the density patch with the optical sensor 43 is described in detail. As shown in FIG. 20, the light irradiated from the light emitting element 301 to the ETB 31 as the base is reflected in accordance with a refractive index peculiar to a material of the base surface (surface of the ETB 31) and a refractive index determined by the surface state, and is detected by the light receiving element 302. When the density patch is formed on the base surface, as shown in FIG. 21, the base of the portion where a black toner T1 exists is covered, whereby the reflection light amount decreases. Therefore, the regular reflection light amount decreases along with the increase of the toner amount of the density patch as shown in FIG. 22, and the density of the density patch can be obtained based on the decrement. In actuality, the state of the base surface changes in accordance with the degree of the usage of the ETB 31, which makes the reflection light amount fluctuate. Thus, in general, the reflection light amount of the density patch is standardized based on the reflection light amount of the base, and then converted into density information.

However, a problem arises in the case where a toner of a chromatic color is detected. In the case where the chromatic color toner is irradiated with light, a light perceived as a color is reflected. The reflection light is called diffuse reflection light or diffusion reflection light. The diffuse reflection light has characteristics that the reflection light amount increases accompanied with the increase of the color material (=toner) amount and that it is diffused uniformly in all directions.

Therefore, the light detected in the case where the density patch comprised of a chromatic color toner T2 is detected by the optical sensor corresponds to the sum of the light which has undergone regular reflection by the base and which decreases along with the increase of the toner amount and the light which has undergone diffuse reflection by the toner and which increases along with the increase of the toner amount, as shown in FIG. 23. Accordingly, as shown in FIG. 24, the relationship between the toner amount and the reflection light amount corresponds to the sum of a thin solid line that shows the characteristic of the regular reflection and a broken line that shows the characteristic of the diffuse reflection, and has a negative characteristic as shown by a thick solid line (a characteristic that the reflection light amount starts to increase again when the toner amount increases to a certain level or more). Therefore, linearity necessary for density detection cannot be obtained.

From the above, in this embodiment, the diffuse reflection component is subtracted from the reflection light amount at the time of the detection of the density patch to get only the regular reflection component.

In this embodiment, the same patch as the density patch directly formed on the ETB 31 is formed on a black solid image formed on the ETB 31, and density detection is conducted using the above-mentioned two patches in combination, whereby only the regular reflection light component is extracted. As to the characteristic of the reflection light in the case where the density patch formed on the black solid image formed on the ETB 31 is detected, the regular reflection light component from the base is covered by the black solid image, and only the diffuse reflection light component is obtained as shown in FIG. 25. The diffuse reflection light component detected here is subtracted from the reflection light of the density patch directly formed on the ETB, namely, the sum of the regular reflection light component and the diffuse reflection light component, whereby only the regular reflection light component is extracted to be used for density detection. As a result, the relationship between the density of the density patch and the reflection light amount is expressed as the one-to-one relationship shown in FIG. 22.

As described above, only the regular reflection light is extracted to perform density detection. Thus, the linearity can be obtained in the relationship between the toner amount of the density patch and the output of the optical sensor even at the time of detection of the chromatic color toner, and therefore, the density detection can be performed with accuracy.

Operation of the Dmax control in this embodiment is described. In this embodiment, the colors for the process stations 201 to 204, which are the process means, are in the order of black, magenta, yellow and cyan. FIG. 26 shows a structure of a density patch 21 used in this embodiment. As shown in FIG. 26, the density patch 21 is formed in which patterns, in each of which 2×3 dots in a 4×4 dot matrix are filled up, are reiterated.

First, the process station 201 of the black toner is controlled to form black solid images 20 like stepping-stones on the ETB 31 as shown in FIG. 18B. When each of the images reaches the position of the optical sensor, a reflection output VzO of the black solid portion and a reflection output VO of the base portion between the black solid portions are taken in the optical sensor. This signal is subjected to A/D conversion, and then taken in a CPU.

Next, as shown in FIG. 18A, the process stations 202 to 204 are controlled to form the density patches shown in FIG. 26 on the images 20 and between the images 20. When each of the density patches reaches the position of the optical sensor, an output voltage Vzp of the density patch on the black solid image 20 and an output voltage Vp of the density patch formed between the black solid images are taken in the optical sensor. This signal is subjected to A/D conversion, and then taken in the CPU.

Further, prior to the above-described operation, a sensor output voltage (cal) at the time when the light emitting element is turned OFF (the minimum light amount) is measured. The reflection light intensity at the time when each density patch, the base and the like are measured corresponds to the resultant obtained by subtracting the output voltage at the time of measurement from the cal voltage. At this time, an output Vi (after standardization) of only the regular reflection light component is expressed as follows.

$$Vi=[(cal-Vp)-\{(cal-Vzp)-(cal-VzO)\}]/(cal-VO).$$

Vi is converted into density information Di based on a density conversion table. In this embodiment, the above-described operation is repeated five times while changing image forming conditions (developing bias in this embodiment) to obtain density information D1 to D5. At this time, the developing bias is changed so as to make the density higher in the order of D1 to D5. Based on the density information, there is calculated the developing bias in which the density of the halftone density patch has the optimum value (called Dt here).

After the detection of all the patches, the relationship between the developing bias and the density of the density patch can be obtained as shown in FIG. 27. Among those, two density patches sandwiching the optimum value Dt of the density are picked out, and linear interpolation is conducted between the two points, whereby there is calculated the developing bias at which the density of the density patch has the optimum value Dt. The above-described operation is conducted with respect to every color, and the developing bias at which the image density is the most suitable is calculated for each color. After the completion of the above-described calculation, the density patches on the ETB 31 are electrostatically collected in the process station, and the next control or printing process is provided.

Next, the Dhalf control is described. In the Dhalf control, in order to prevent that a natural image is not formed by fluctuation of an output density to an input image signal due to a nonlinear input/output characteristic peculiar to electrophotography (γ-characteristic), image processing is conducted such that the γ-characteristic is cancelled to maintain the input/output characteristic in a linear state. The nonlinearity is more conspicuous in the case where halftone is constituted with a finer matrix such as a 3×3 dot matrix as a unit in order to obtain high-definition images. Specifically, in the Dhalf control, a plurality of density patches with different input image signals are detected by an optical sensor to thereby obtain the relationship between the input image signal and the density. Based on the relationship, the image signal input to the image forming apparatus is converted by a controller of the image forming apparatus in order to obtain a desired density to the input image signal from a host computer (hereinafter referred to as γ-conversion).

In the Dhalf control as well, the same density detection as described in this embodiment is conducted to obtain density information Dj. The density information Dj is sent to the controller, and the controller conducts the γ-correction based on the density information. After the completion of the above-described calculation, the density patches on the ETB are electrostatically collected in the process station. The next control or printing process is provided.

As described above, the output of the halftone density patch for density detection is corrected by using the detection output of the density patch formed on the black solid image to conduct the image density control. Therefore, also in the case where the density of the chromatic color toner is detected by the optical sensor of the type for detection of the regular reflection light, density control can be performed with accuracy.

Note that, the description is made using the ETB (conveying belt) in this embodiment, but the same effect can be obtained with the structure in which the intermediate transfer belt (ITB), the intermediate transfer drum or the like is used.

Figure 28:
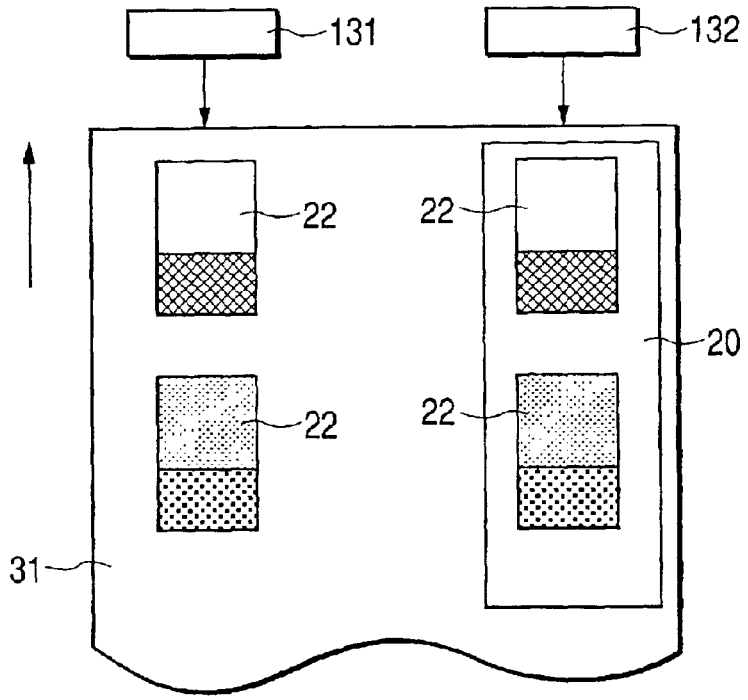
FIG. 28 is a diagram explaining operation of an image forming apparatus in accordance with still another embodiment of the present invention.
Figure 29A:
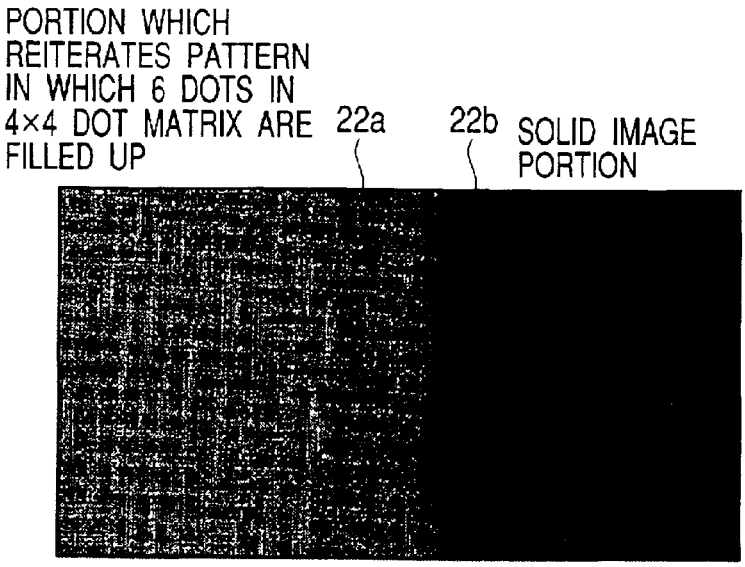
FIGS. 29A and 29B are diagrams explaining a detection pattern used in image density control.
Figure 29B:
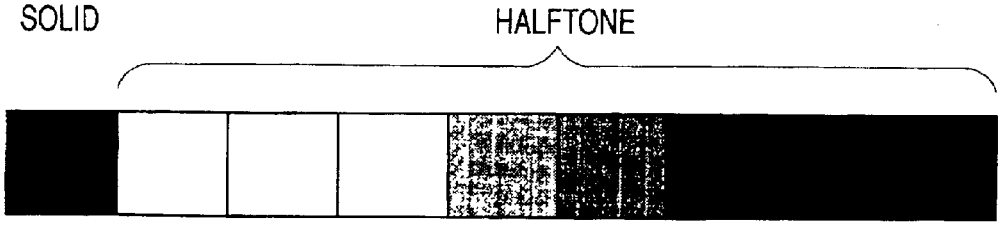

Next, an image forming apparatus in accordance with another embodiment of the present invention will be described with reference to the accompanying drawings. FIG. 28 is a diagram explaining an operation of the image forming apparatus in accordance with this embodiment, and FIGS. 29A and 29B are diagrams explaining a detection pattern used in image density control in this embodiment. The parts that overlap those in the structure of the image forming apparatus in accordance with the above-described embodiment are denoted by the same reference symbols, and a description therefor is omitted.

In the above-described embodiment, there is described the density control in which the single optical sensor 43 detects the density patches on the ETB 31 and on the black solid image. However, in the case where a large number of density patches are formed especially as in the Dhalf control, the total sum of the length of the density patches is too large and exceeds the peripheral length of the ETB 31, and thus, the control has to be conducted in plural installments. Therefore, there is a fear that the time necessary for conducting the control increases. Accordingly, an object of this embodiment is to reduce the time necessary for conducting the control.

In this embodiment, a method in which two optical sensors are used is described. In this embodiment as well, since density detection can be performed with the optical sensor with a simple structure as in the above-described embodiment, registration detection sensors for prevention of color shift can be used also as optical sensors, which are symmetrically arranged on both sides in a width direction of the ETB 31 (direction perpendicular to a direction of movement of the ETB). Therefore, the lowering of cost is attained without the addition of a special optical sensor. Further, in this embodiment as well, the color order of the process stations 201 to 204 is the order of black-magenta-yellow-cyan.

As shown in FIG. 28, between two optical sensors 131 and 132, the optical sensor 131 detects a density patch 22 directly formed on the ETB 31, and the other optical sensor 132 detects the density patch 22 formed on a black solid image 20. Thereafter, as in the above-described embodiment, the reflection light intensity (diffuse reflection light component) of the density patch 22 formed on the black solid image 20 is subtracted from the reflection light intensity (the sum of the regular reflection light component and the diffuse reflection light component) of the density patch 22 directly formed on the ETB 31 to extract only the regular reflection light component, thereby conducting density detection.

In the case where the two optical sensors are used, the light amount of the light emitting element is not always the same between the two optical sensors. Thus, the intensity of the diffuse reflection light to the same toner amount differs between the two optical sensors, and the reflection light intensity (diffuse reflection light component) of the density patch formed on the black solid image cannot be subtracted from the reflection light intensity (the sum of the regular reflection light component and the diffuse reflection light component) of the density patch directly formed on the ETB 31 as they are. Therefore, it is preferable that the light emission amount is made the same between the two optical sensors. However, it is not preferable that a light receiving element and a light amount control mechanism are mounted for control of the light emission amount because this leads to the increase of cost of the optical sensor.

Thus, in this embodiment, as shown in FIGS. 29A (Dmax control) and 29B (Dhalf control), a density patch 22*a* that is the same as that in the above-described embodiment is added with a solid patch 22*b*, and the reflection light intensity is compared between the patches, whereby the difference of the light emission amount between the optical sensors is corrected.

It is described above that the reflection light of the density patch formed on the black solid image is only the diffuse reflection light component. Next, an output of the solid patch 22*b* directly formed on the ETB 31 is considered. In this case, since the base is not seen because a toner sufficiently covers the base, the detected reflection light does not contain the regular reflection light component reflected by the base. Therefore, the reflection light detected at this time is only the diffuse reflection component. That is, the solid patch 22*b* on the ETB and the solid patch 22*b* on the black solid image 20 have the same reflection characteristic, and the difference in the reflection light intensity between the patches 22*b* corresponds to the difference of the light emission amount between the optical sensors.

By utilizing this, the reflection light intensity of the density patch 22 on the black solid image 20 (diffuse reflection light component) of one optical sensor is converted into the reflection light intensity based on the light emission amount of the other optical sensor. Thereafter, the converted reflection light intensity is subtracted from the reflection light intensity of the density patch 22 directly formed on the ETB 31. As a result, the same density detection as in the above-described embodiment can be performed.

Specifically, assuming that a light emission amount of one optical sensor is M1, a light emission amount of another optical sensor is M2, a reflectance of a regular reflection light component is N, and a reflectance of a diffuse reflection light component is n, the reflection light intensities are expressed as follows:

on the ETB: Pe=M1×N+M1×n on the black solid image: Pz=M2×n

At the time of detection of the solid patch, N→0 (the regular reflection light component does not exist). Thus, the outputs are expressed as follows:

on the ETB: Pef=M1×n on the black solid image: Pzf=M2×n

Therefore, the ratio of the light emission amount between the two optical sensors is expressed as follows.

$$M1/M2=Pef/Pzf$$

The reflection light intensity obtained by converting the diffuse reflection light intensity on the black solid image based on the light emission amount of the other optical sensor is expressed as follows.

$$M1\times n=(M2\times n)\times(M1/M2)=Pz\times(Pef/Pzf)$$

A regular reflection light component Pi is expressed as follows.

$$Pi=Pe-Pz\times(Pef/Pzf)$$

In the actual detection, assuming that a sensor output voltage at the time when the light emitting element is turned OFF (the minimum light amount) is cal, an output voltage of the density patch on the black solid image is Vzp, an output voltage of the density patch formed on the ETB 31 is Vp, a reflection output voltage of the black solid portion is VzO, a reflection output voltage of the base portion is VO, an output voltage of the solid patch on the black solid image is Vfz, and an output voltage of the solid patch on the ETB 31 is Vf, an output of only the regular reflection light component Vi (after standardization) is expressed as follows.

$$Vi=[(cal-Vp)-(cal-Vf)\times\{(VzO-Vpz)/(VzO-Vfz)\}]/(cal-VO)$$

Vi is converted into density information Di based on the density conversion table, and is used for the calculation of the developing bias and the γ-correction as in the above-described embodiment.

As described above, the two optical sensors are used, whereby the time necessary for conducting control can be reduced, and at the same time, since the optical sensor with a simple structure can be used as in the above-described embodiment, density detection can be conducted by the registration detection sensor, thereby being capable of lowering the cost.

An image forming apparatus in accordance with still another embodiment of the present invention will be described. Incidentally, the parts that overlap those in the structure of the image forming apparatus in accordance with the above-described embodiment are denoted by the same reference symbols, and a description therefor is omitted.

In the above-described embodiment, it is described that the colors for the process stations 201 to 204, which are the process means, are in the order of black-magenta-yellow-cyan. On the contrary, the case where the colors for the process stations 201 to 204 are in the order of cyan-yellow-magenta-black is considered in this embodiment.

In the in-line type image forming apparatus, there may be a case where a phenomenon called re-transfer occurs in which an image formed on a transfer material P is scraped when passing the process station of another color to thereby lower the density. A black toner is often used for text images, and thus, the density lowering of the black toner is not preferable in comparison with other color toners. Therefore, there are many image forming apparatuses having a structure in which the process station for the black toner is arranged on the most downstream side to prevent the density lowering.

In the case where the process station for black is arranged on the most downstream side in the conveying direction of the transfer material P, a black solid image is formed prior to the formation of a density patch of a chromatic color, and the density patch of the chromatic color is formed in the next circuit. However, in the case where this is performed with the same structure as that in the above-described embodiment as it is, the black solid image is distorted by passing the attractive roller 35 before the density patch of the chromatic color is formed, and the effect of the black solid image for covering the base is reduced. Thus, the effect described in the above-described embodiment cannot be expected.

From the above, in this embodiment, a bias voltage having the same polarity as the toner is applied to the attractive roller 35 in the execution of the image density control in order that the black solid image is not distorted by the attractive roller 35. In this embodiment, a bias of −300 V is applied to the attractive roller 35.

With the above-described structure, even in the case where the process station for the black toner is arranged on the most downstream side, the black solid image is not distorted by the attractive roller 35, and the same effect as in the above-described embodiment can be obtained. Thus, image density control can be performed with stability.

Next, an image forming apparatus in accordance with still another embodiment of the present invention will be described with reference to the accompanying drawings. Incidentally, the parts that overlap those in the structure of the image forming apparatus in accordance with the above-described embodiment are denoted by the same reference symbols, and a description therefor is omitted.

In this embodiment, a structure is explained in which the density of a chromatic color toner is detected based on a diffuse reflection light and the density of a black toner is detected based on a regular reflection light. The optical sensor of the type for detection of the regular reflection light is used as in the above-described embodiments.

As described above, in order to detect a highlight region sensitive to a visual characteristic with accuracy, it is desirable for both the chromatic color toner and the black toner that the regular reflection light is detected. However, with respect to the chromatic color toner, since secondary colors (overlap of colors) are used, it is preferable that the maximum deposit amount of the toner is controlled in view of the prevention of poor fixation and of scatters of images. Therefore, the density patch at as high density as possible is preferably detected. Thus, it is desirable to detect the sensitive diffuse reflection light in the high-density region.

In this embodiment, the density patch of the chromatic color toner is formed on the black solid image as in the above-described embodiments. However, the density patch is not compared with the density patch directly formed on the ETB 31, and only the diffuse reflection light is detected, thereby conducting density detection. That is, the density detection is conducted by using the characteristic expressed by the broken line in FIG. 24.

At this time, the output of the light emitting element 301 of the optical sensor 43 is controlled by a not-shown control device so as to maintain a constant light emission amount.

Further, with respect to the black toner, density detection is conducted by detecting the regular reflection light as in the above-described embodiments.

With the above-described structure, the maximum deposit amount of the chromatic color toner can be controlled with accuracy. Even in the case where the secondary colors are used, the occurrence of the poor fixation and scatters of images can be prevented.

As described above, the detection result of the detection pattern of the chromatic color toner formed on the black toner image, namely, the diffuse reflection light component is subtracted from the detection result of the detection pattern of only the chromatic color toner, that is, the sum of the regular reflection light component and the diffuse reflection light component, whereby only the regular reflection light component, which is sensitive to the visual characteristic, which has the strong reflection light intensity, and which provides high detection accuracy can be extracted by using the simpler detecting means. Thus, the negative characteristic due to the diffuse reflection light component is corrected, and therefore, the density detection can be performed with higher accuracy.

Further, the registration detection sensor, which generally adopts the sensor with a simpler structure than that of the sensor used for density detection, can be used also as the density detection sensor. Therefore, the lowering of cost can be attained.

The embodiments of the present invention are described above. However, the present invention is not limited to the above-described embodiments, and any modifications of the embodiments are possible in the technical ideas of the present invention.

What is claimed is:

1. An image forming apparatus comprising:

image forming means for forming an image, wherein said image forming means can form a toner image for density detection; and detecting means for irradiating light onto the toner image for density detection and detecting light obtained from the toner image for density detection, wherein said image forming means is controlled based on an output from said detecting means, wherein the toner image for density detection includes a first toner image and a second toner image having a light reflectance lower than that of the first toner image, and wherein when a density of the first toner image is detected, said detecting means detects the first toner image formed on the second toner image.

2. An image forming apparatus according to claim 1, wherein said detecting means includes light emitting means and light receiving means.

3. An image forming apparatus according to claim 2, further comprising amplifying means for amplifying an output from said light receiving means, wherein an amplification width of said amplifying means differs in accordance with a toner image.

4. An image forming apparatus according to claim 1, wherein said detecting means further detects the first toner image for which the second toner image is not formed as a base, and the density of the first toner image is detected based on the output from said detecting means that has detected the first toner image in a case where the base exists and in a case where the base does not exist.

5. An image forming apparatus according to claim 4, wherein the density of the first toner image is detected based on a difference between the output from said detecting means that has detected the first toner image in the case where the base exists and the output from said detecting means that has detected the first toner image in the case where the base does not exist.

6. An image forming apparatus according to claim 1, further comprising a bearing member bearing a toner image for density detection.

7. An image forming apparatus according to claim 6, wherein said detecting means includes light receiving means, and said light receiving means receives a regular reflection light from said bearing member.

8. An image forming apparatus according to claim 6, wherein said bearing member is movable, and the toner image for density detection is provided on both sides of said bearing member in a direction perpendicular to a direction of movement of said bearing member.

9. An image forming apparatus according to claim 6, further comprising a photosensitive member, wherein said bearing member is an intermediate transfer member temporarily bearing a toner image between said photosensitive member and a recording material at the time of transfer of the toner image on said photosensitive member to the recording material.

10. An image forming apparatus according to claim 6, wherein said bearing member bears and conveys a recording material.

11. An image forming apparatus according to claim 10, further comprising attractive means for attracting the recording material on said bearing member, wherein a bias voltage having the same polarity as the toner is applied to said attractive means when the toner image for density detection passes a position of said attractive means.

12. An image forming apparatus comprising:

image forming means for forming an image, wherein said image fanning means can form a toner image for density detection; and detecting means for irradiating light onto the toner image for density detection and detecting light obtained from the toner image for density detection, wherein said image forming means is controlled based on an output from said detecting means, wherein the toner image for density detection includes a first toner image and a second toner image, the first toner image is a toner image of a color different from black, and the second toner image is a black toner image, and wherein when a density of the first toner image is detected, said detecting means detects the first toner image formed on the second toner image.

13. An image forming apparatus according to claim 12, wherein said detecting means includes light emitting means and light receiving means.

14. An image forming apparatus according to claim 13, further comprising amplifying means for amplifying an output from said light receiving means, wherein an amplification width of said amplifying means differs in accordance with a toner image.

15. An image forming apparatus according to claim 12, wherein said detecting means further detects the first toner image for which the second toner image is not formed as a base, and the density of the first toner image is detected based on the output from said detecting means that has detected the first toner images in a case where the base exists and in a case where the base does not exist.

16. An image forming apparatus according to claim 15, wherein the density of the first toner image is detected based on a difference between the output from said detecting means that has detected the first toner image in the case where the base exists and the output from said detecting means that has detected the first toner image in the case where the base does not exist.

17. An image forming apparatus according to claim 12, further comprising a bearing member bearing a toner image for density detection.

18. An image forming apparatus according to claim 17, wherein said detecting means includes light receiving means, and said light receiving means receives a regular reflection light from said bearing member.

19. An image forming apparatus according to claim 17, wherein said bearing member is movable, and the toner image for density detection is provided on both sides of said bearing member in a direction perpendicular to a direction of movement of said bearing member.

20. An image forming apparatus according to claim 17, further comprising a photosensitive member, wherein said bearing member is an intermediate transfer member temporarily bearing a toner image between said photosensitive member and a recording material at the time of transfer of the toner image on said photosensitive member to the recording material.

21. An image forming apparatus according to claim 17, wherein said bearing member bears and conveys a recording material.

22. An image forming apparatus according to claim 21, further comprising attractive means for attracting the recording material on said bearing member, wherein a bias voltage having the same polarity as the toner is applied to said attractive means when said toner image for density detection passes a position of said attractive means.

* * * * *

UNITED STATES PATENT AND TRADEMARK OFFICE

CERTIFICATE OF CORRECTION

PATENT NO. : 6,775,489 B2
DATED : August 10, 2004
INVENTOR(S) : Takaaki Tsuruya et al.

It is certified that error appears in the above-identified patent and that said Letters Patent is hereby corrected as shown below:

Column 8,
Line 5, “image” (second occurrence) should read -- the image --; and
Line 38, “though” should read -- through --

Column 9,
Line 10, “completed” should read -- being completed --.

Column 10,
Line 67, “derail.” should read -- detail. --.

Column 17,
Lines 9, 20, 25 and 38, “follows.” should read -- follows: --.

Column 20,
Line 35, “fanning” should read -- forming --.

Signed and Sealed this

Ninth Day of August, 2005

JON W. DUDAS
*Director of the United States Patent and Trademark Office*